US010478001B2

(12) United States Patent
Ivakhnyuk et al.

(10) Patent No.: US 10,478,001 B2
(45) Date of Patent: Nov. 19, 2019

(54) METHOD AND APPARATUS FOR DISPOSABLE GLOVE DISPENSING

(71) Applicants: Yaroslav Ivakhnyuk, Bristol, CT (US); Anthony Uccello, Wethersfield, CT (US)

(72) Inventors: Yaroslav Ivakhnyuk, Bristol, CT (US); Anthony Uccello, Wethersfield, CT (US)

(73) Assignee: Simple Innovations LLC, Bristol, CT (US)

( * ) Notice: Subject to any disclaimer, the term of this patent is extended or adjusted under 35 U.S.C. 154(b) by 104 days.

(21) Appl. No.: 15/859,346

(22) Filed: Dec. 30, 2017

(65) Prior Publication Data

US 2019/0200793 A1 Jul. 4, 2019

(51) Int. Cl.
*A47G 25/90* (2006.01)
*A41D 19/00* (2006.01)

(52) U.S. Cl.
CPC ..... *A47G 25/904* (2013.01); *A41D 19/0093* (2013.01); *A41D 2400/44* (2013.01); *A41D 2400/52* (2013.01)

(58) Field of Classification Search
CPC ..... B65D 33/14; A47G 25/90; A47G 25/904; A41D 19/04; A41D 19/00; A41D 19/0003; A41D 19/0044; A41D 19/0048; A41D 19/0055; A41D 2400/44; A41D 2400/52
USPC ..... D2/641
See application file for complete search history.

(56) References Cited

U.S. PATENT DOCUMENTS 4,228,935 A * 10/1980 Madray ..... A47G 25/904 2/161.6
4,898,309 A 2/1990 Fisher
5,706,988 A * 1/1998 Moore ..... A47G 25/905 223/111
6,375,034 B1 4/2002 Corbett
6,419,131 B1 * 7/2002 Rix ..... A47G 25/904 223/111
6,578,729 B2 * 6/2003 Grinberg ..... A41D 19/0072 2/159
8,533,868 B2 9/2013 Bhalla
8,657,151 B2 2/2014 Balkin
8,919,620 B2 * 12/2014 Taylor ..... A47G 25/905 223/111

(Continued)

*Primary Examiner* — Ismael Izaguirre
(74) *Attorney, Agent, or Firm* — Emanus, LLC; Willie Jacques

(57) ABSTRACT

A glove dispenser is disclosed that permits sanitary donning of gloves by a user without the user touching the exterior of the glove during the donning process. The disclosed apparatus includes a plurality of glove attachment areas configured on a platform that allows disposable and non-disposable gloves to be releasably attached to it by their cuffs, and present the inside of the glove cuffs to a user for easy sanitary donning. As such, a user may open the glove by pulling on the inner portion of the cuff with one hand, inserting the other hand into the opened glove, releasing the pulled cuff, and simply detaching the donned glove from the dispenser. Furthermore, the invention provides a new method for holding and donning gloves of various sizes, materials, construction, etc. while preventing a user from touching the exterior of the gloves, thus preventing contamination of the gloves.

17 Claims, 29 Drawing Sheets

(56) References Cited

U.S. PATENT DOCUMENTS

| | | | | |
|---|---|---|---|---|
| 8,960,493 | B1 * | 2/2015 | Dennison | A47G 25/904 221/45 |
| 9,078,647 | B2 | 7/2015 | Dennison et al. | |
| 2011/0204105 | A1 * | 8/2011 | Kelly | A47G 25/904 223/111 |

* cited by examiner

METHOD AND APPARATUS FOR DISPOSABLE GLOVE DISPENSING

BACKGROUND OF THE INVENTION

This invention relates generally to providing an improved dispensing apparatus and method for donning sanitary disposable or non-disposable gloves, and in particular, donning disposable medical gloves without touching and potentially contaminating the exterior surface of the gloves.

Disposable gloves are used in the medical industry to prevent the transmission of bacteria or other contaminants to users and to others (i.e., patients.). It is typical for these gloves to be dispensed from a common cardboard box similar to those used to dispense disposable facial tissues. In order to don a pair of gloves traditionally, the user typically grabs a glove and pulls it from the box using an ungloved hand. Using one ungloved hand, the user slips the glove onto the other hand, after which the gloved hand is used to grab the second glove from the box and then to don it upon the ungloved hand. Additionally, many users pull out two gloves with their ungloved hands prior to donning, thus potentially contaminating the outer surface of both gloves. Examination of this process shows that the boxed clean gloves become contaminated by the user in the donning process by contact of the user's ungloved hands. As such, it is reasonable to believe that both gloves are likely to become unsanitary. Furthermore, the user then uses these potentially unsanitary gloves to transfer contamination to other surfaces, patients, or other individuals. Another drawback to traditional glove donning technique is the length of time that is required for the process. The standard practice of donning a pair of gloves may take as long as 30 seconds, thus presenting a barrier to efficient medical care. In addition to the previously claimed drawbacks, the traditional box-glove design presents a high probability of material waste as multiple gloves may involuntarily fall out of the box onto the floor thus requiring discarding of such gloves. The gloves in a traditional box-glove remain unorderly in a tight container, thus the opening of the box creates a pathway to potential glove waste and exposure to contaminants from the outside environment. Studies show that unused, non-sterile disposable gloves (NSDG) may actually become contaminated with pathogens during the act of glove retrieval. Contaminated NSDG therefore have the potential to act as transmission vehicles for bacteria as demonstrated by these results. These studies suggest that traditional glove-box design and glove withdrawal techniques should be further examined to decrease the potential for pathogen transfer to unused sanitary gloves. Furthermore, the World Health Organization (WHO) states that bacteria transmission can result from inappropriate donning and withdrawing of medical disposable gloves, as improper hand hygiene results in the direct transfer of contaminants to the sanitary gloves. According to WHO, hand hygiene (e.g., proper hand washing or sanitizing) compliance in the health care setting can be as low as 0%, with compliance levels most frequently recorded below 40%. This statistic is a big contributing factor for hospital acquired infections (HAI's), which according to Centers for Disease Control (CDC), U.S. hospitals reported that in 2011 there were an estimated 722,000 HAIs in U.S. acute care hospitals, and 75,000 deaths stemming from HAI's. These studies show the urgent need for further improvement of the infection control process.

The prior art reflects various attempts at solutions for dispensing gloves while precluding their contamination by a user. U.S. Pat. No. 6,375,034, to Corbett discloses a device that permits a user to don gloves without touching the exterior of the glove. The device responds to voice command to move the gloves which are attached to filaments in position for donning. Once in position, shears are used to separate the gloves from the filaments. Such a system can be problematic as it relies on the need for extra parts such as shears and filaments, and power to operate, and more importantly presents filaments and shears in proximity to a user's hands which increases the likelihood of injury. Additionally, the use of filaments and shears for handling and dispensing the gloves presents sharp objects on/near the gloves which could damage them during operation of the device.

In U.S. Pat. No. 8,533,868, to Bhalla, a sterile glove is disclosed which advantageously presents to a user a glove with the inside portion of the cuff folded over to prevent touching the outside of the glove. Bhalla uses a donning tab and shield attached to the inside surface of the cuff fold to allow a user to grasp a glove for donning. Despite providing initial protection of the outside portion of the glove prior to donning, this design has numerous potential problems. One such problem is that the opening of the glove for slipping in a user's hands can potentially collapse as the donning tab and shield provides little to no supporting structure for a user to handle the glove. Those skilled in the art can appreciate the difficulty of donning tight-fitting latex gloves, for example. Another problem is that once the lower portion of the glove is donned to a user's hand, careful (i.e., time-consuming) attention needs to be employed by a practitioner to prevent contamination of the glove while removing the donning tab and shield. The process of removing the donning tab and shield opens the risk of contamination to the glove as the user must use the other hand to fold the cuff into its normal position on the hand without risk of tearing the glove. Furthermore, the addition of the donning tab and shield adds to the cost of gloves, complicates packaging and makes donning more time consuming.

A method and apparatus for disposable glove dispensing is disclosed in U.S. Pat. No. 8,960,493, to Dennison et. al. The disclosure discusses a glove dispensing system that may allow a user to efficiently put on a disposable glove without touching the outside of the glove. The device relies on the opening of gussets to allow a user to insert their hands into a disposable glove. As disclosed by Dennison, the gloves must be separated at a tearing joint to create an opening for the hand. Per the disclosure, the gloves hang back-to-back on a dispensing apparatus so it is difficult to conceive opening a first glove on the dispenser without touching the outside surface of the glove. Furthermore, the gloves as contemplated in the '493 patent to Dennison, must be specially made to fit the dispensing apparatus and as such eliminates use of existing disposable gloves.

U.S. Pat. Appl. Publication No. 2016/0362242, to Tao, discloses a disposable glove dispensing system whereby gloves are dispensed cuff-first as a means of reducing contamination risk. As provided in the disclosure, the outer surface of the glove cuffs is presented to a user for donning. Those skilled in the art will appreciate that it is the outside surface of the glove cuff that must be protected from contamination during the donning process. As such, risk of contamination is ever-present since the exposed outer glove cuff may be touched, first, by unsanitary hands. It is also recognized that traditional glove boxes are made of paper/cardboard where studies show the risk of contamination (e.g., bacteria) resulting from moisture build-up in such materials. In addition, typical glove boxes are discarded after gloves are used up, contributing to unnecessary waste.

U.S. Pat. No. 4,898,309, to Fisher describes a device for facilitating the donning of sterile gloves with elastic cuffs. A major drawback to this device is that it is configured for holding only one glove or a pair of gloves at a time. In an environment where multiple gloves must be used by many caregivers at the same time, the device presents time consuming and inefficient to use. Specifically, the device must be prepared (i.e., loaded with a glove or pair of gloves) each time donning is required as donning is not available until a subsequent glove or pair of gloves is first installed onto the device.

Other glove dispensing devices as disclosed in the prior art, such as U.S. Pat. Appl. No. 2007215628, to Tramontina, exhibit similar setbacks of still presenting possible contamination while donning a glove to a user's hand. Tramontina discloses gloves in a box with cuffs folded inside out to allow a user to grab a glove without touching the outside surface of the glove. However, the user must still don the glove without the aid of a support to efficiently position the glove on the hand; this procedure is time consuming and still presents a risk of contamination from accidentally touching the outside surface of the glove while donning. Furthermore, the user, having touched the inside portion of the folded cuff, must still unfold the cuff of the glove to expose the outside portion of the cuff to provide sufficient protection to both the user and person or object later touched. These known methods tend to unnecessarily increase the cost and complexity of use (i.e., donning) and manufacture of the gloves. In addition, no one solution adequately addresses such increases in cost and complexity as it relates to, for example, dispenser infrastructure needs (e.g., electrical power), time savings, and compatibility with existing glove products of different sizes and materials. As such, what is needed is an apparatus and method that permits a user to efficiently don gloves, throughout the entire donning process, without contaminating the outside surface of the glove while also eliminating the aforementioned inadequacies.

OBJECTS AND FEATURES OF THE INVENTION

Accordingly, several objects and advantages of the present invention are to provide an apparatus and method for sanitary dispensing and donning of gloves by a user without the user touching the outer surface of the gloves. It is a further object and feature of the present invention to provide a glove dispensing apparatus that accommodates gloves of different sizes and/or materials (e.g., latex, vinyl, neoprene, etc.). It is another object and feature of the present invention to provide an efficient and time-saving method of donning gloves to a user's hands. It is another object and feature of the present invention to provide a glove dispensing apparatus that presents a singular and/or multiplicity of gloves in an organized fashion and in a natural hand position for glove donning, while retaining the remaining gloves in the apparatus upon/after withdrawal of the outermost glove. Another object of the present invention is to provide a glove dispensing apparatus that may inhabit the traditional location of glove boxes by conveniently locating the apparatus on a wall or standing base structure. It is a further object and feature of the present invention to provide a glove dispensing apparatus that does not require special or dedicated utilities (e.g., electrical power, assisted devices, etc.) for operation, as well as minimizing touching of the apparatus itself. Yet another object of the present invention is to provide a means for minimizing material waste. Likewise, another object and feature of the present invention is to provide a glove dispensing apparatus that does not require a change in design of currently used gloves. It is still a further object and feature of the present invention to provide a glove dispensing apparatus which minimizes the exposure of the gloves to the outside environment when the dispenser is not in use. Further objects and features of the present invention will become apparent from a consideration of the drawings and ensuing description.

SUMMARY OF THE INVENTION

In accordance with an embodiment hereof, the present invention provides a means for sanitary glove dispensing using an apparatus configured for holding gloves on a dispensing platform that is generally configured with a glove attachment area. A glove dispenser is configured with a glove attachment area, comprised of a plurality of lips and indents on the left side and the right side of the glove attachment area. The glove attachment area provides a functional surface for securing gloves while also providing means for a user to easily don gloves onto the hand without touching the outside surface of the glove. Exemplary aspects of the glove dispensing apparatus allow a plurality of gloves to be secured to the glove attachment area by stretching and folding their cuff over the lips, and by utilizing the elastic force of the cuff and/or bead of a glove, allow the bead to be retained in the indents of the glove attachment area. When folded over the lips of the glove attachment area, the inside surface of the cuff, of all gloves secured to the glove attachment area, becomes the outer facing surface. The inner cuff of the outermost glove (and subsequent gloves once the outermost glove is detached) are presented to a user for donning.

Another aspect of the dispensing apparatus provides means for a user to pull on the exposed inner portion of the cuff to open the glove while its secured to the glove attachment area, allowing the other hand to be inserted in the opened glove (i.e., becoming donned), and then allowing the donned glove to be detached from the glove attachment area (i.e., the surface formed by lips and indents on the left side and the right side of the glove attachment area) by pulling generally upward from the platform without disturbing the remaining gloves on the platform.

Yet another aspect of the dispensing apparatus is to enable a multiplicity of gloves to be "layered" atop each other on a glove attachment area for convenient and efficient dispensing of many gloves.

A further aspect of the present invention is to provide a glove dispensing apparatus that can be conveniently located in a user-friendly location and position for glove donning, such as on a wall or on a stand for providing quick and easy access. In a further aspect of the present invention, an apparatus for holding and dispensing gloves does not require a change in the design (e.g., size, material, construction, etc.) of currently used gloves. The aforementioned embodiment and aspects of the present invention also include a means for protecting the glove dispensing apparatus with protective plastic packaging, rigid covering, or any material which allows access by a user to the gloves, while also protecting the gloves from exposure to outside contaminants.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

This detailed description discusses various exemplary embodiments to support disclosure of the present invention. While these exemplary embodiments are described in sufficient detail to enable those skilled in the art to practice the invention, it should be understood that other embodiments may be realized and that modifications of structures, arrangements, or components used in the practice of the instant invention, in addition to those not specifically recited, can be varied or otherwise adapted to specific environments, manufacturing specifications, design parameters or other operating requirements without departing from the scope of the present invention and are intended to be included in this disclosure. As such, the detailed description herein is presented for purposes of illustration only and do not constrain the invention to specific limitations.

It is contemplated that many alternatives may become apparent as presented in disclosed arrangement of elements.

For instance, examples describing a left side and a right side of a structure may be described alternatively as a right side and a left side of the same structure. In addition, a glove may refer to an outermost presented to a user wishing to don the glove. Disclosed herein are one or more configurations of apparatuses, an exemplary sanitary method for inserting hands into disposable gloves and donning gloves without touching their outside surface.

The disposable gloves as discussed herein may be made of latex, nitrile, polyethylene, polyvinyl chloride, vinyl, and other suitable materials. The disposable gloves may also have different thicknesses and can come in separate or combined packs of different sizes, such as small, medium, or large, and the like. Use of terms in this disclosure like disposable, sanitary, sterile, and the like to describe gloves, are not to be construed as limiting the type of gloves in any of the embodiments presented herein as being one or another, but either or all types.

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made individually or collectively when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1A:
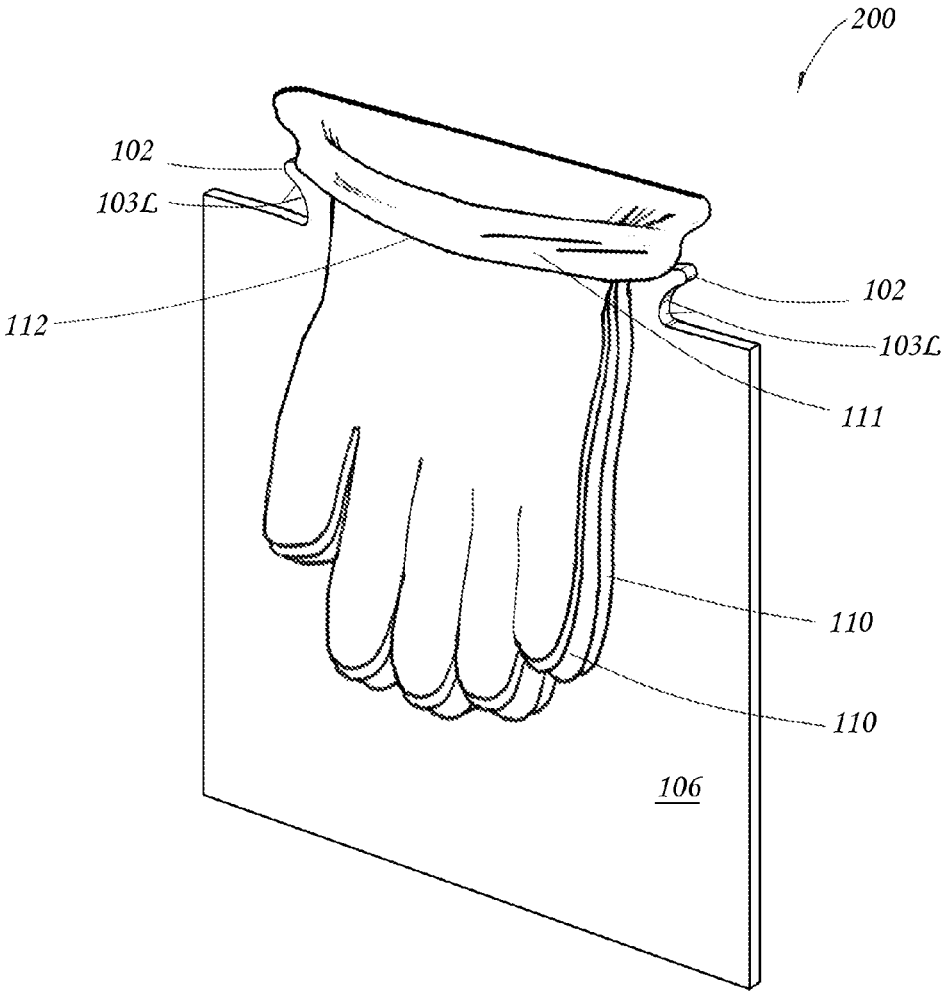
FIG. 1A is a perspective view of a glove dispenser showing gloves stacked onto the glove attachment area, in accordance with various embodiments of the present disclosure.
Figure 1B:
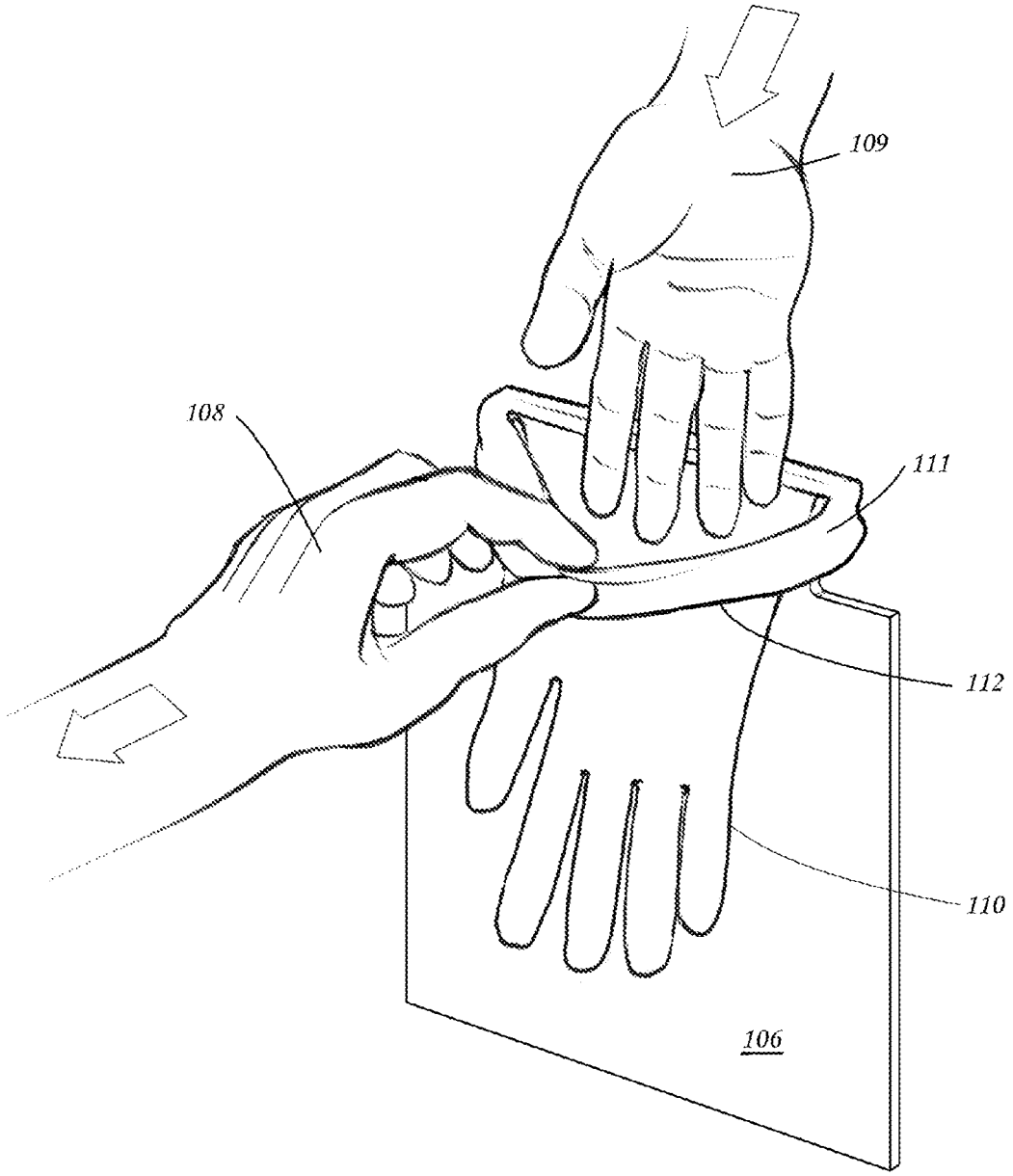
FIG. 1B is a perspective view of a user opening a glove by pulling on the inner cuff of the glove secured to glove attachment area of a dispenser with one hand, and placing the other hand into the opened glove, in accordance with various embodiments of the present disclosure.
Figure 2A:
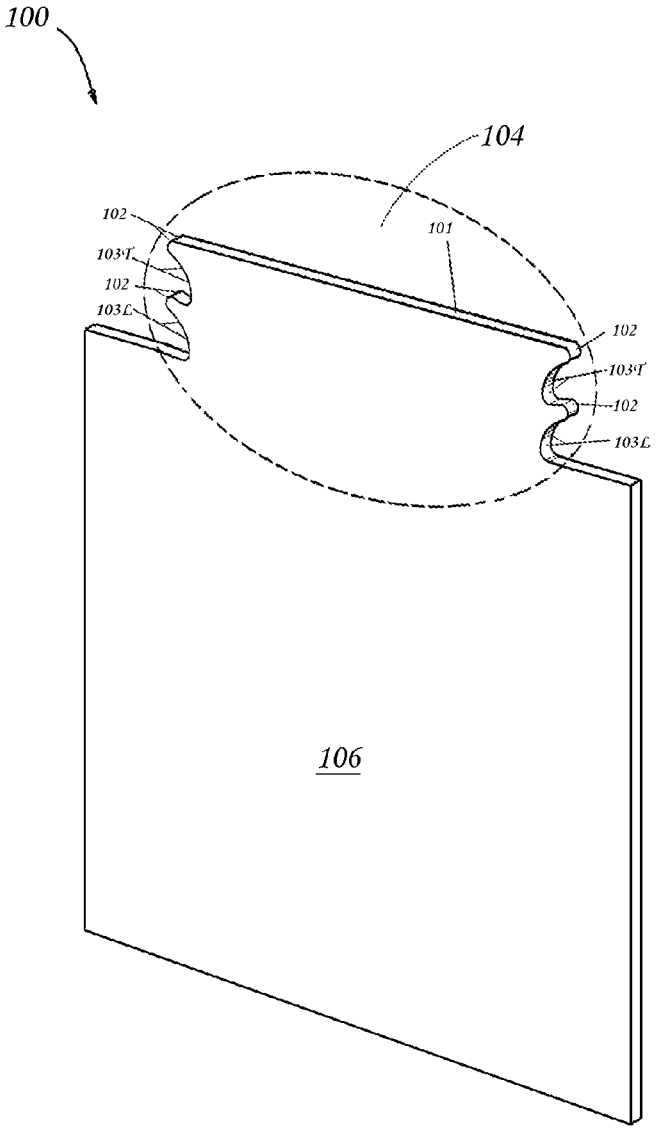
FIG. 2A is a perspective view of a glove dispenser with a glove attachment area, comprised of lips and indents configured thereon, in accordance with various embodiments of the present disclosure.

According to various embodiments and with reference to FIGS. 1A and 2A, a disposable glove dispensing system comprises a glove dispenser 100, comprised of a glove attachment area 104 (See FIG. 3C), itself comprised of lips 102 and indents 103, where lips 102 and indents 103 of a glove attachment area 104 are generally horizontally opposed on a left side and a right side of the glove attachment area 104. Generally, a glove attachment area 104 rests on a platform face 106.

Again, by reference to FIGS. 1A and 2A, a disposable glove 110 is attached onto the glove attachment area 104 by stretching the cuff 111 of glove 110 and inverting the cuff 111 over the lips 102 thus exposing the inner cuff 111 of the glove 110, whereby the inside of the glove cuff 111 is exposed and presented to a user. Glove 110 is thereby positioned so that the cuff 111 is held elastically in the glove attachment area 104, and the glove bead 112 comes to rest at or proximal to indents 103 on each side of the glove attachment area 104. Multiple gloves 110 may be assembled onto the glove attachment area 104 by placing a glove 110 over the previous glove (i.e., stretching inverted cuff 111 over lips 102). Lips 102 and indents 103 are configured, generally horizontally opposed, at the left side and right side of the glove attachment area 104, of sufficient width between them so that one or more gloves 110 are held in place on the glove attachment area 104 by elastic tension. It is contemplated that a plurality of gloves 110 may be assembled onto a top set of indents 103T of a glove attachment area 104; likewise, another plurality of gloves 110 may be assembled onto a next lower set of indents 103L of a glove attachment area 104.

Figure 1C:
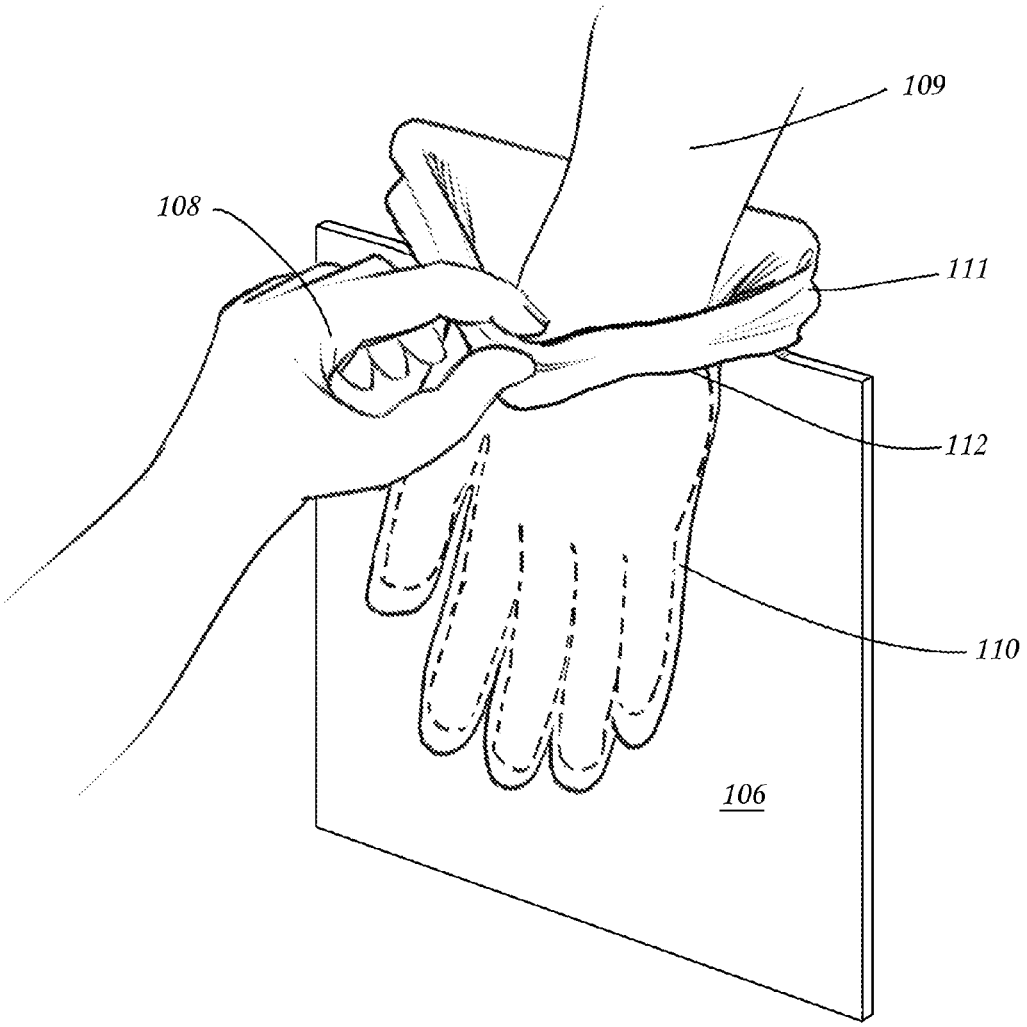
FIG. 1C is a perspective view illustrating a user with hand in a glove that is secured onto the glove attachment area of a dispenser, in accordance with various embodiments of the present disclosure.
Figure 1D:
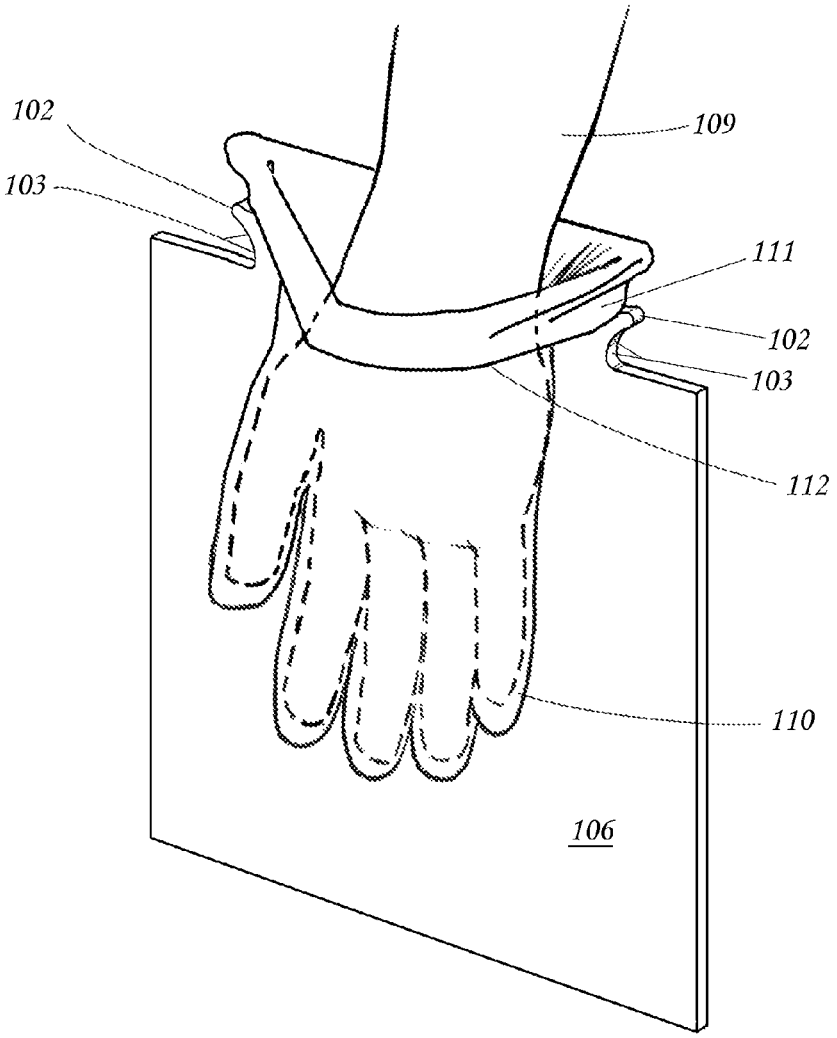
FIG. 1D is a perspective view illustrating the cuff of a glove released onto a user's hand that has been placed in a glove secured onto the glove attachment area of a dispenser, in accordance with various embodiments of the present disclosure.
Figure 1E:
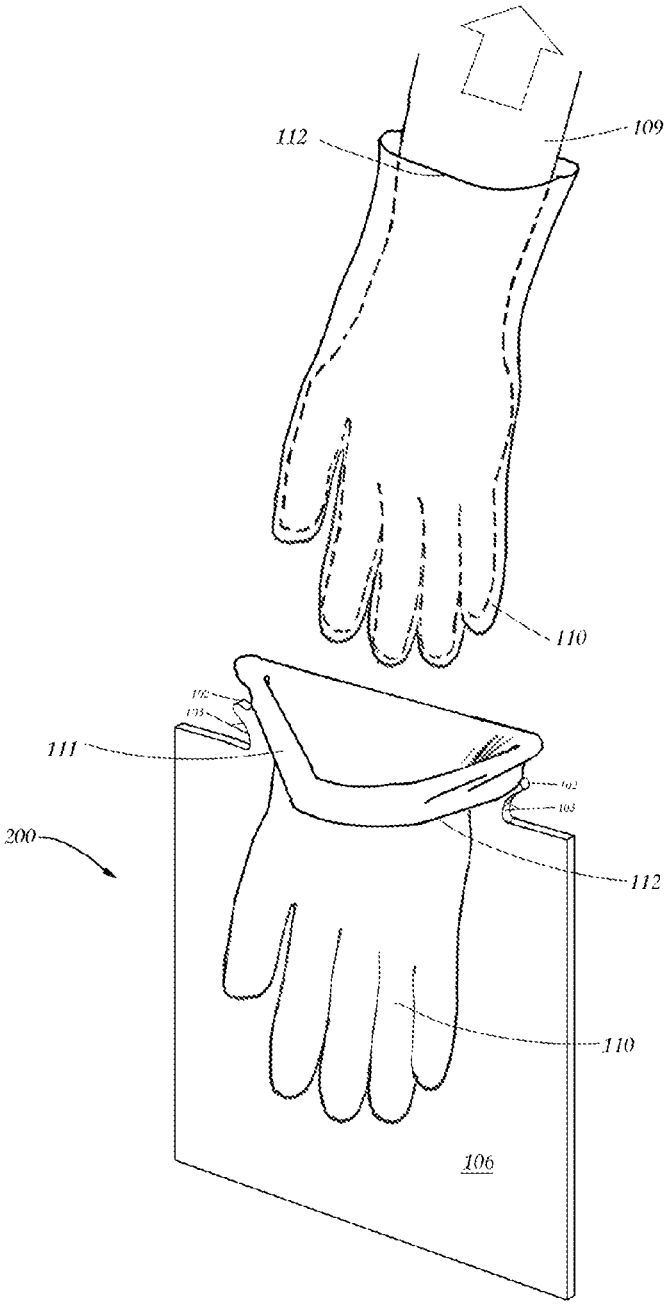
FIG. 1E is a perspective view illustrating a glove, donned on a user's hand, being detached from the dispenser by the user pulling up and away from the glove attachment area of a dispenser, in accordance with various embodiments of the present disclosure.

The process of donning a glove 110 may be understood by reference to FIGS. 1B-1E. By reference to FIG. 1B, an outermost glove 110 on glove attachment area 104 is first opened by a user pulling on the exposed inner cuff 111 of a glove 110 with one hand 108 and then inserting the other hand 109 into the opened glove. A user's hand 109 sits in the glove 110, and then the cuff 111 is released by user hand 108 onto the other hand 109 as illustrated in FIGS. 1C-1D. As shown in FIG. 1E, to complete the donning process, having not touched the outside surface of glove 110, a user pulls up and away from the dispenser 200 thereby releasing the elastic hold of the glove 110 on the glove attachment area 104 and detaching the glove 110 fully donned to user hand 109, according to an embodiment of the present invention. Other methods of detaching a glove 110 may be intuitively identified by a user, such as when the user's hand 109 sits in the glove 110 and the cuff 111 is released, the user may move the gloved hand 109 in a leftward or rightward direction, generally horizontally, to release glove 110 from lip 102 of the corresponding side of the glove attachment area 104, and similarly move hand 109 in the opposite direction to release glove 110 from the opposing lip 102 on its corresponding side of the glove attachment area 104.

Figure 2B:
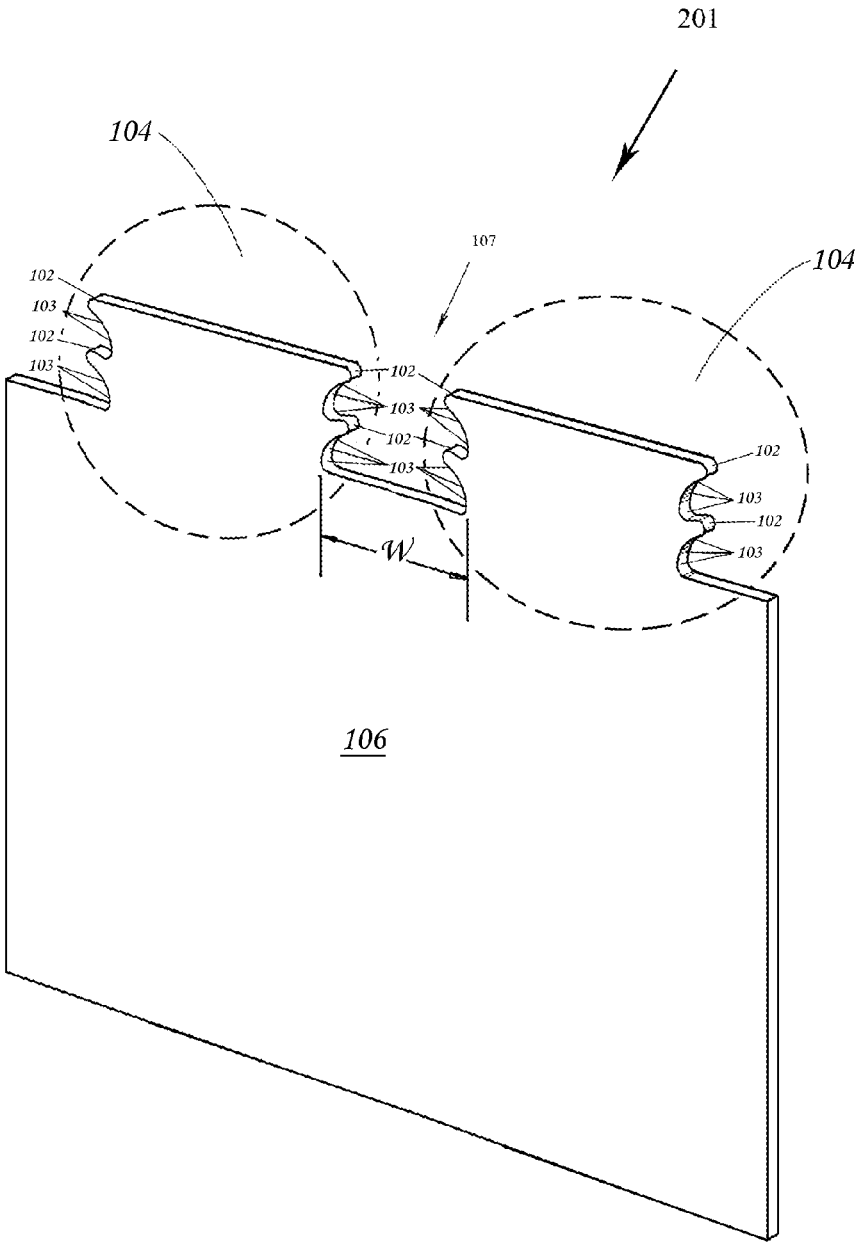
FIG. 2B is a perspective view of a glove dispenser having glove attachment areas configured thereon, horizontally opposed on a platform, in accordance with an embodiment of the present disclosure.

FIG. 2B depicts an exemplary embodiment of the present invention. Glove dispenser 201 is fashioned with two horizontally opposed glove attachment areas 104, for increasing the amount of gloves 110 available on a glove dispenser. Glove dispenser 201 provides a means of donning a user's left hand and right hand from a left side glove attachment area 104 and a right side glove attachment area 104, respectively, in accordance with an embodiment of the present invention. It is contemplated that the gloves 110 may be oriented onto any glove attachment area 104 to accommodate either a left-hand glove or a right-hand glove, respectively. The width "W" of trough 107 is sufficient to accommodate placement and dispensing of gloves 110 on and from opposing glove attachment areas 104 of dispenser 201, respectively.

Figure 2C:
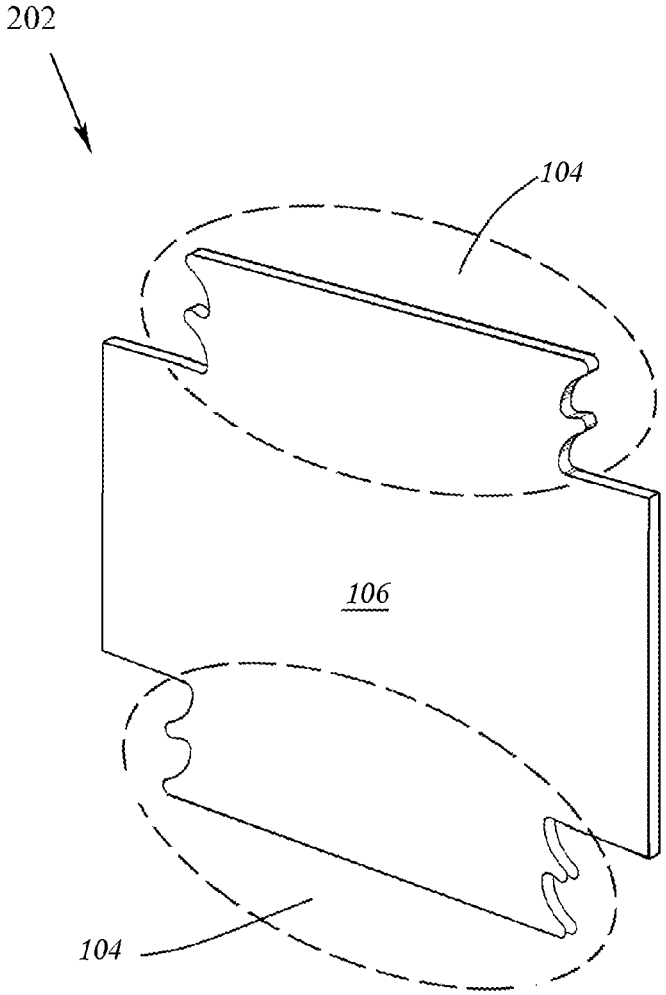
FIG. 2C is a perspective view of a glove dispenser having glove attachment areas configured thereon vertically opposed on a platform, in accordance with an embodiment of the present disclosure.
Figure 2D:
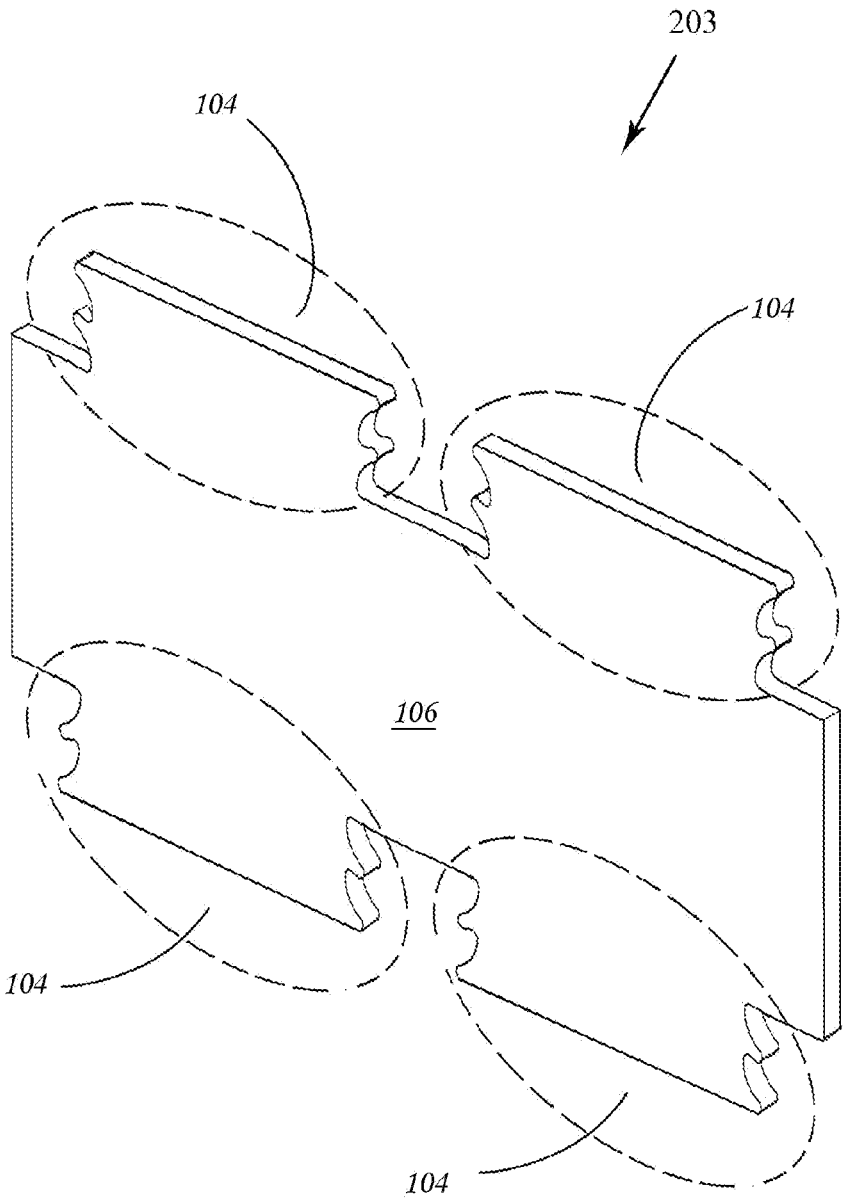
FIG. 2D is a perspective view of a glove dispenser having glove attachment areas configured thereon, horizontally opposed on a top side of a platform, and glove attachment areas configured thereon, horizontally opposed on a bottom side of a platform, respectively, in accordance with an embodiment of the present disclosure.

As illustrated in FIG. 2C, exemplary glove dispenser 202, having glove attachment areas 104A and 104B of different widths, allows for packaging of different sized gloves 110 by orienting glove attachment area 104A or glove attachment area 104B vertically upward, respectively. Furthermore, and similarly to dispensers 201 and 202, an exemplary dispenser 203 as shown in FIG. 2D, may be comprised of a plurality of glove attachment areas 104 constructed on platform face 106 horizontally-opposed, vertically-opposed, or other directional permutations for dispensing gloves. Glove attachment areas 104 may be of different shapes, widths and sizes on a single glove dispenser in order to accommodate different types and sizes of gloves. In addition, the exemplary embodiment 203 provides a means for orienting stacked gloves for donning a user's left hand and right hand from a single glove dispenser, respectively.

Figure 3A:
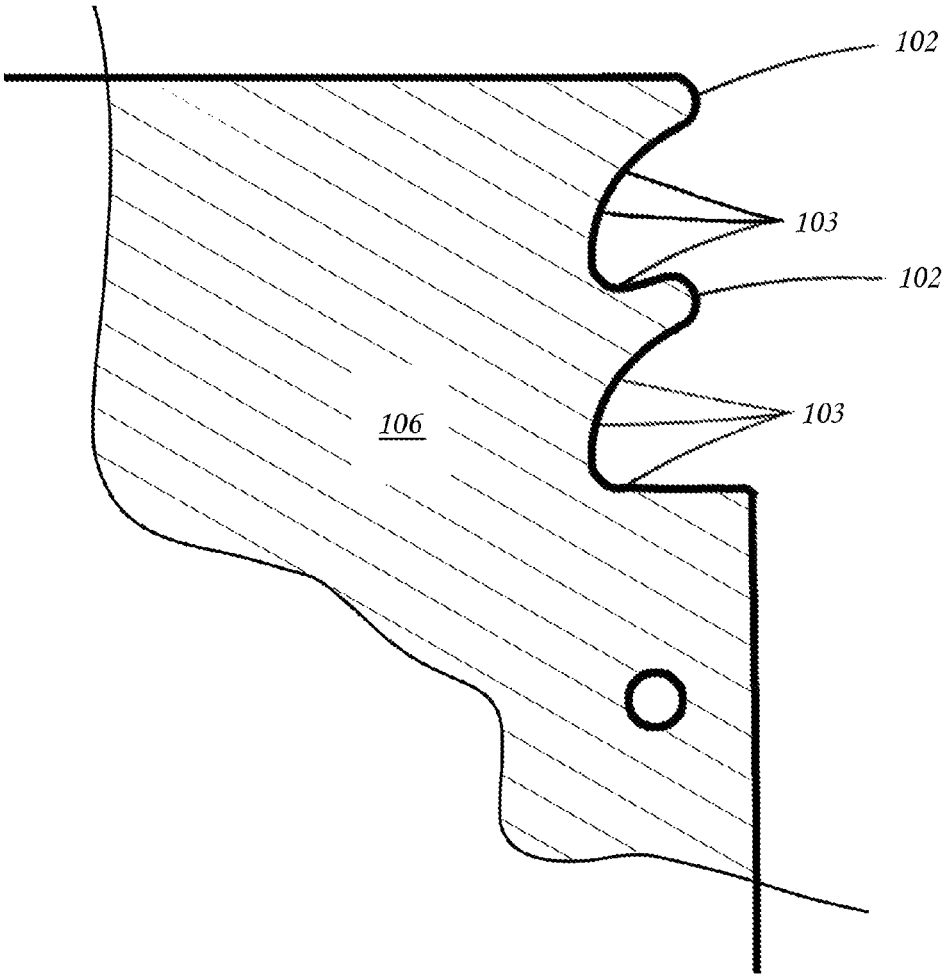
FIG. 3A is a front sectional view of the right side of a glove attachment area showing exemplary lips and indents configured thereon, in accordance with various embodiments of the present disclosure.
Figure 3B:
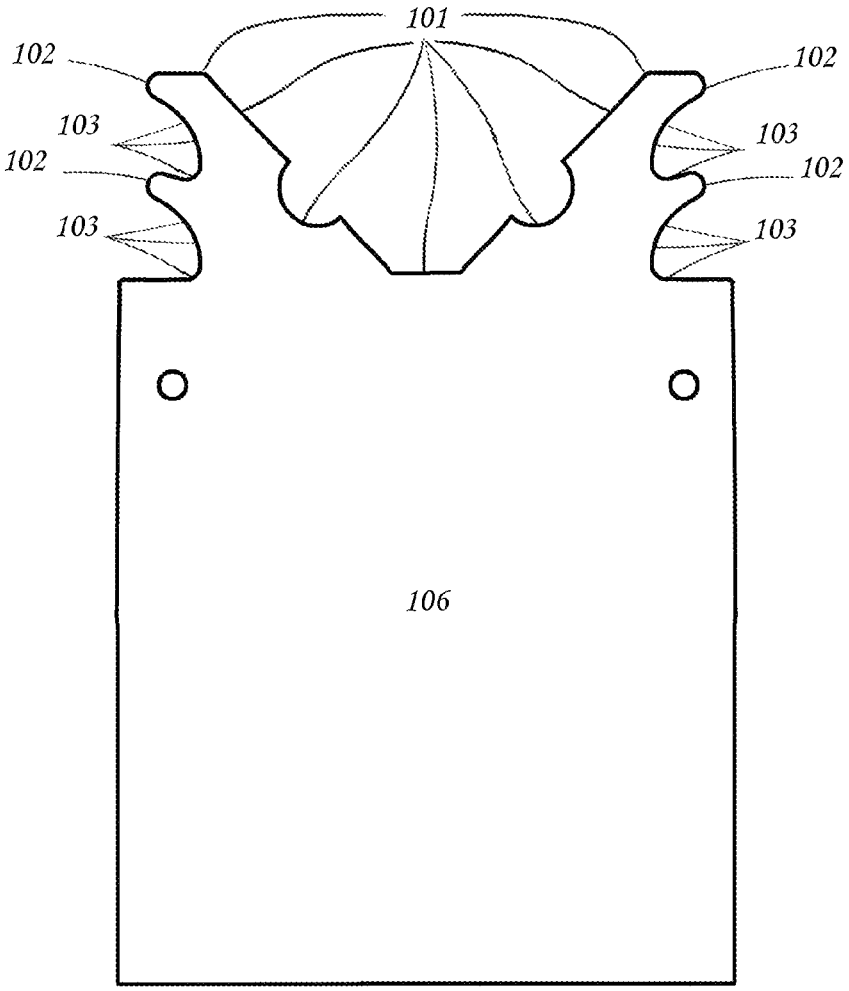
FIG. 3B is a front view of a glove dispenser illustrating an exemplary alternative configuration for a platform beam, in accordance with various embodiments of the present disclosure.
Figure 3C:
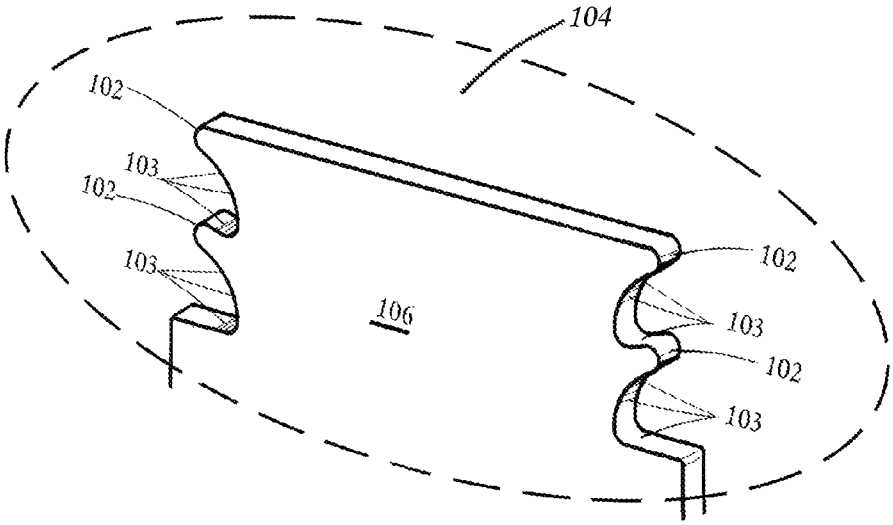
FIG. 3C is close-up perspective view of the left side and the right side of an exemplary glove attachment area.
Figure 3D:
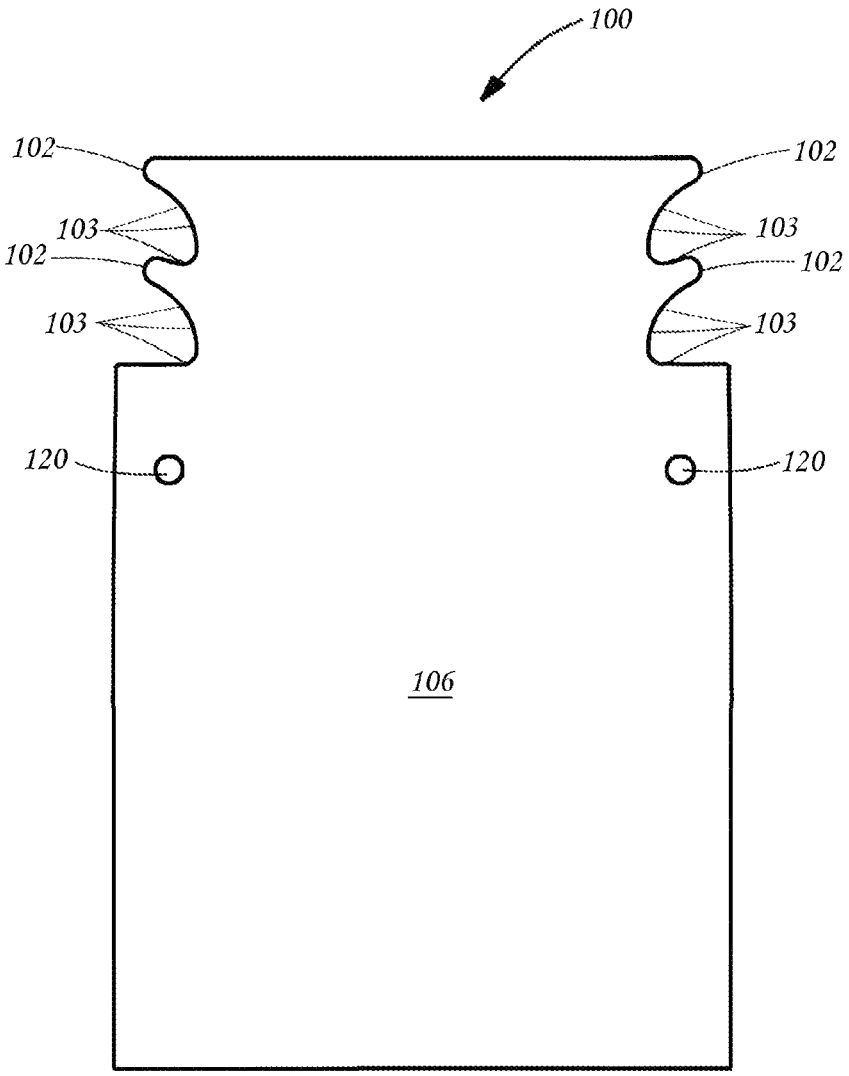
FIG. 3D is a front view of a glove dispenser illustrating the left side and the right side of an exemplary glove attachment area.
Figure 5A:
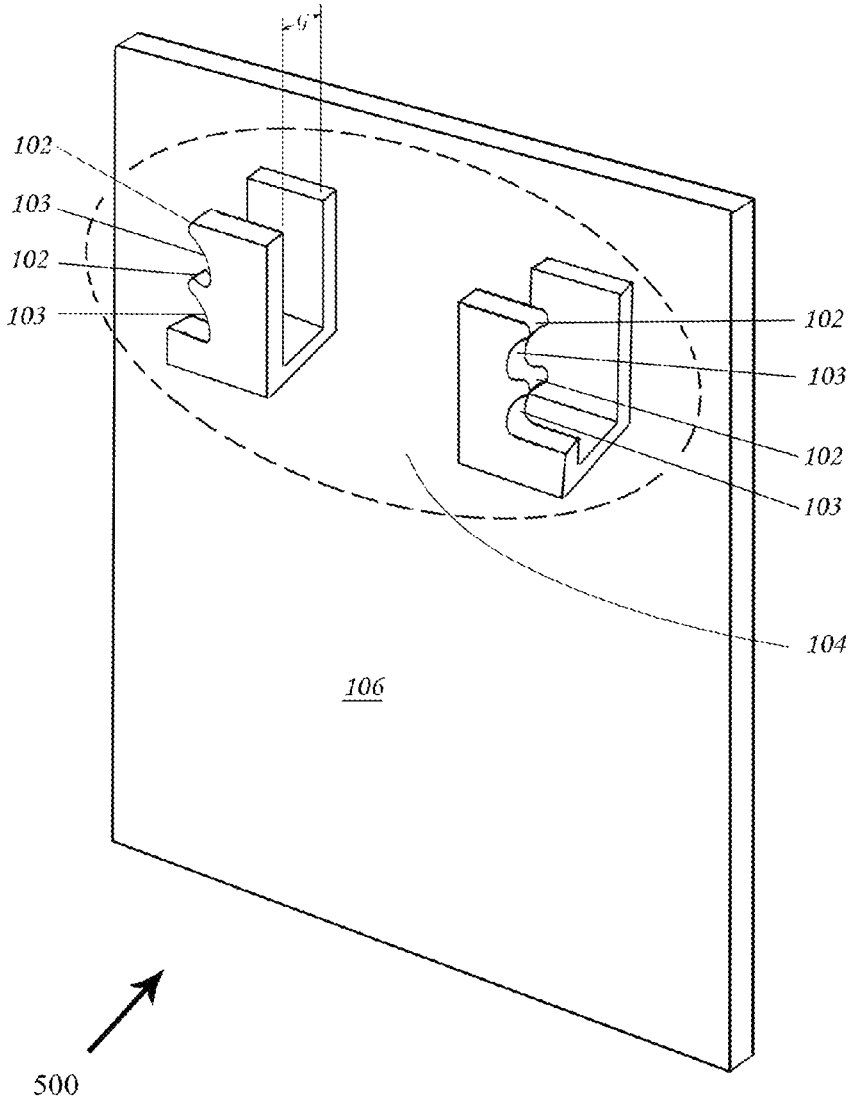
FIG. 5A is a perspective view of a glove dispenser, illustrating an exemplary glove attachment area stand-off from the platform face, in accordance with an embodiment of the present disclosure.
Figure 6A:
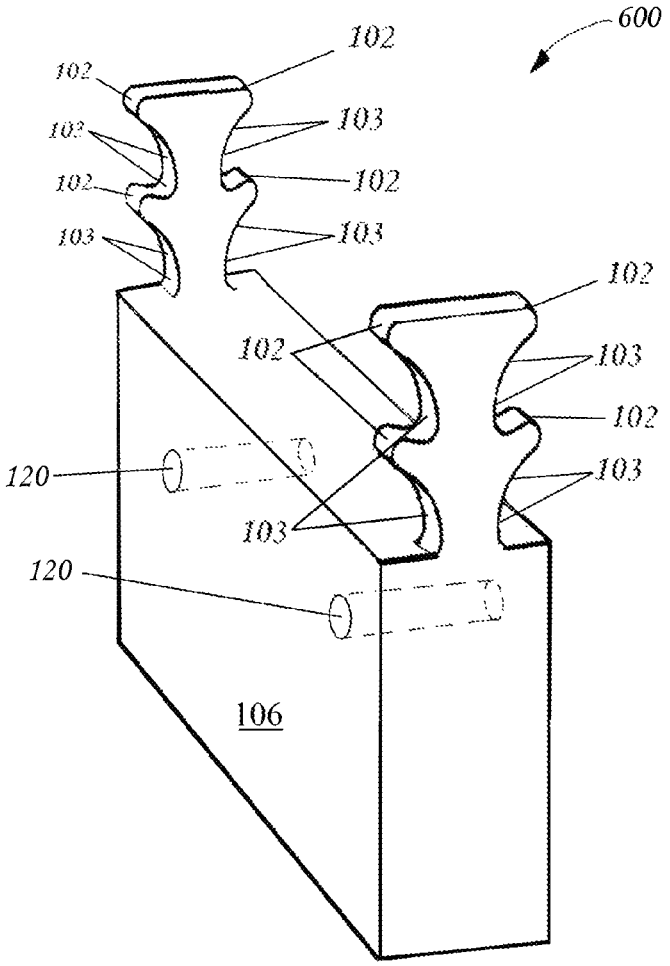
FIG. 6A is a perspective view of an alternative configuration of a glove dispenser, illustrating an exemplary alternative glove attachment area, in accordance with various embodiments of the present disclosure.
Figure 7A:
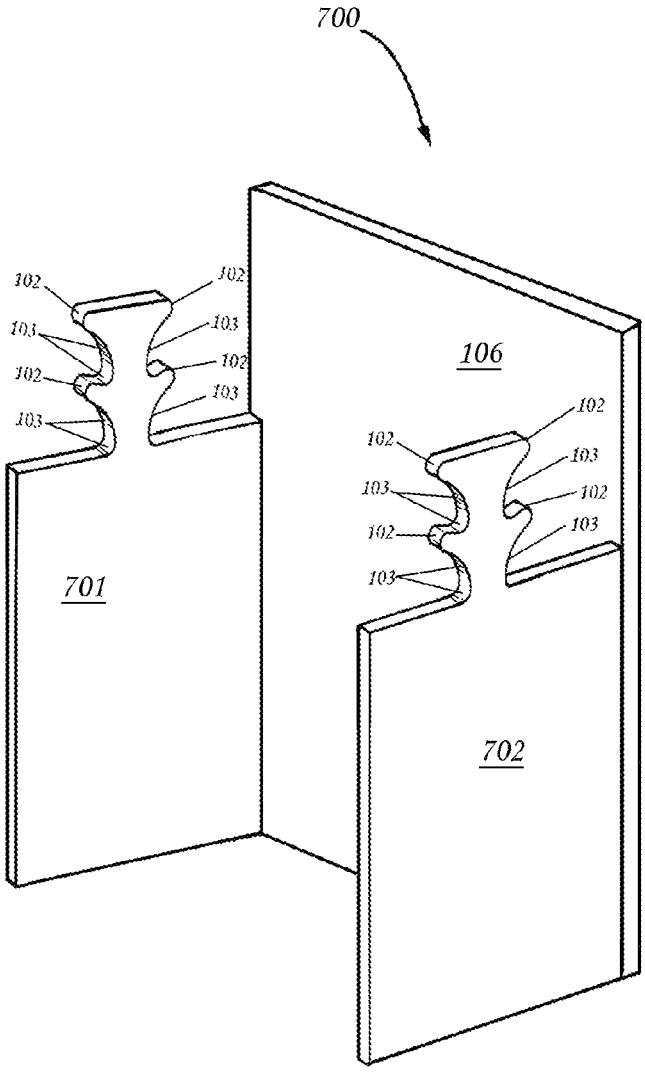
FIG. 7A is a perspective view of a dispenser configured with a left-side panel and a right-side panel, each angled from a platform face and each configured with lips and indents forming a glove attachment area, respectively.

For the sake of clarity, FIG. 3A shows the front view of the right side of a glove attachment area 104 configured with two lips 102 and two indents 103, according to an embodiment of the present invention. Lips 102 and indents 103 may be formed by machining, 3-D printing, molding, or other construction methods as known in the art. Referring to FIG. 3B, in an embodiment of the present invention, it is not necessary that the surface between the left side and the right side of the glove attachment area 104 extend on a straight line. It is contemplated that the surface between the left side and the right side of the glove attachment area 104 may be formed along any straight, angled or curvilinear surface, i.e., beam 101. Furthermore, the surface between the left side and the right side of the glove attachment area 104 may be discontinuous as illustrated in FIGS. 5A, 6A, and 7A for example. FIG. 3C shows a close-up perspective view of a glove attachment area 104.

Figure 4A:
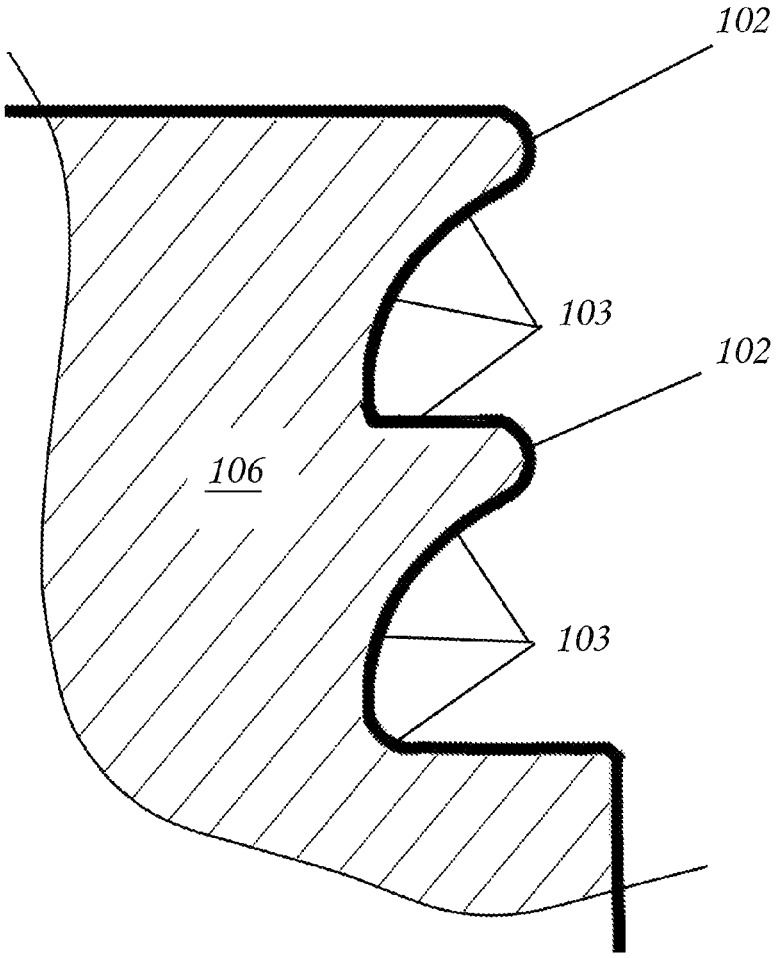
FIGS. 4A-4E are front sectional views of the right side of a glove attachment area illustrating exemplary alternative lip and indent configurations, in accordance with various embodiments of the present invention.
Figure 4B:
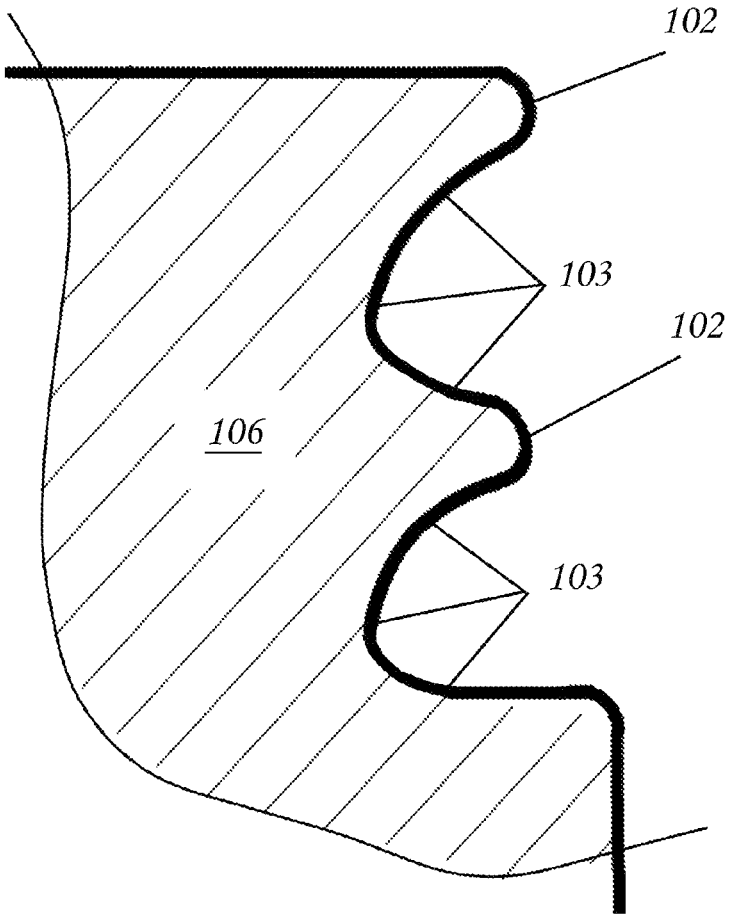
Figure 4C:
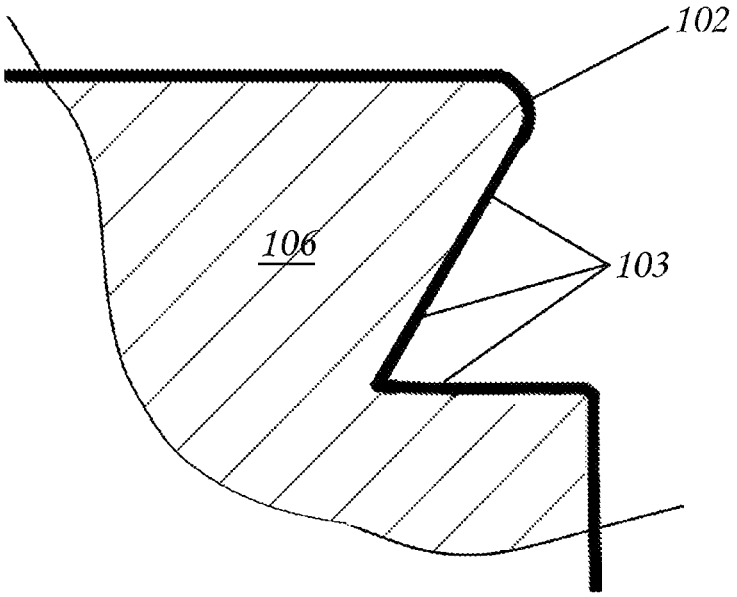
Figure 4D:
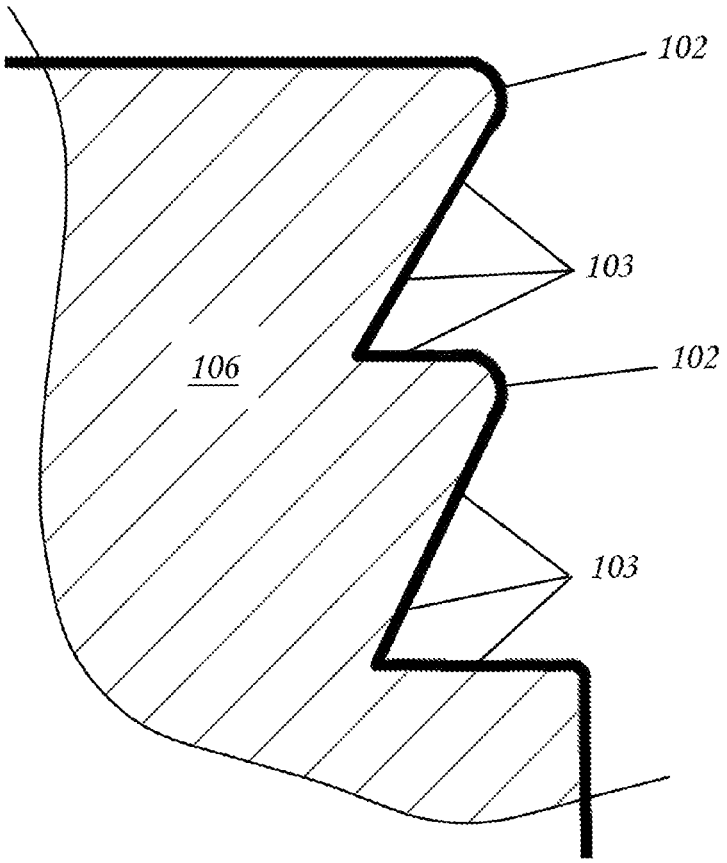
Figure 4E:
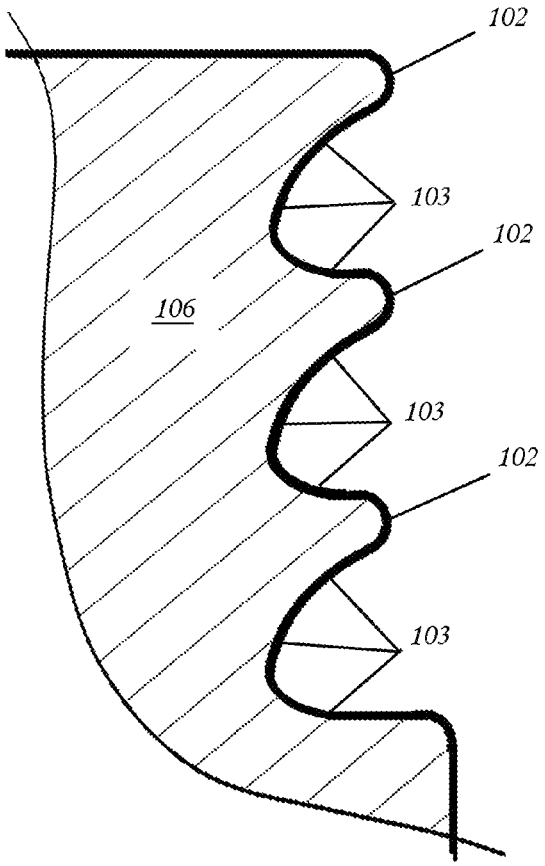

FIGS. 4A-4E illustrate exemplary alternative configurations for lips 102 and indents 103 configured on a side (e.g., on the right-hand side) of a glove attachment area 104, according to various embodiments of the present invention. FIGS. 4A and 4B illustrate how the bottom of an indent 103 may be angled or curved toward a subsequent lip 102 on platform face 106. FIGS. 4C-4D, illustrate exemplary embodiments of the present invention, wherein the right side of the glove attachment area 104 may be comprised of a single lip 102 and indent 103 or multiple lips 102 and indents 103, respectively, wherein the indents 103 may be sharply angled (not curved). In an exemplary embodiment, and by reference to FIG. 4E, a side of a glove attachment area 104 (in this case the right-hand side) may be configured with multiple lips 102 and indents 103 curved or angled upward. Such variances in the shapes and sizes of lips 102 and indents 103 may be used, for example, to accommodate gloves 110 of different sizes, materials or construction, present gloves 110 at different orientations to a user, and/or to provide a greater number of gloves 110 on a glove attachment area 104. It should be understood that such variances in shapes, sizes and configurations of lips 102 and indents 103 may be present on the left-hand side of the glove attachment area 104, likewise. For the sake of clarity, the dimensions, shapes, number of lips 102, and number of indents 103 of exemplary glove attachment area 104, are generally guided by the number, sizes, types, etc. of gloves 110 to be placed on a glove dispenser 100. It is contemplated that any number of lips 102 and indents 103, may be used to form a glove attachment area 104. Exemplary embodiments of lips 102, indents 103, and glove attachment areas 104, as discussed above, illustrate various exemplary embodiments of the present invention, and collectively are not to be construed as limiting or exhaustive of shapes, configurations, sizes, etc. of lips 102, indents 103, and glove attachment areas 104 that fall within the scope of the invention.

Figure 5B:
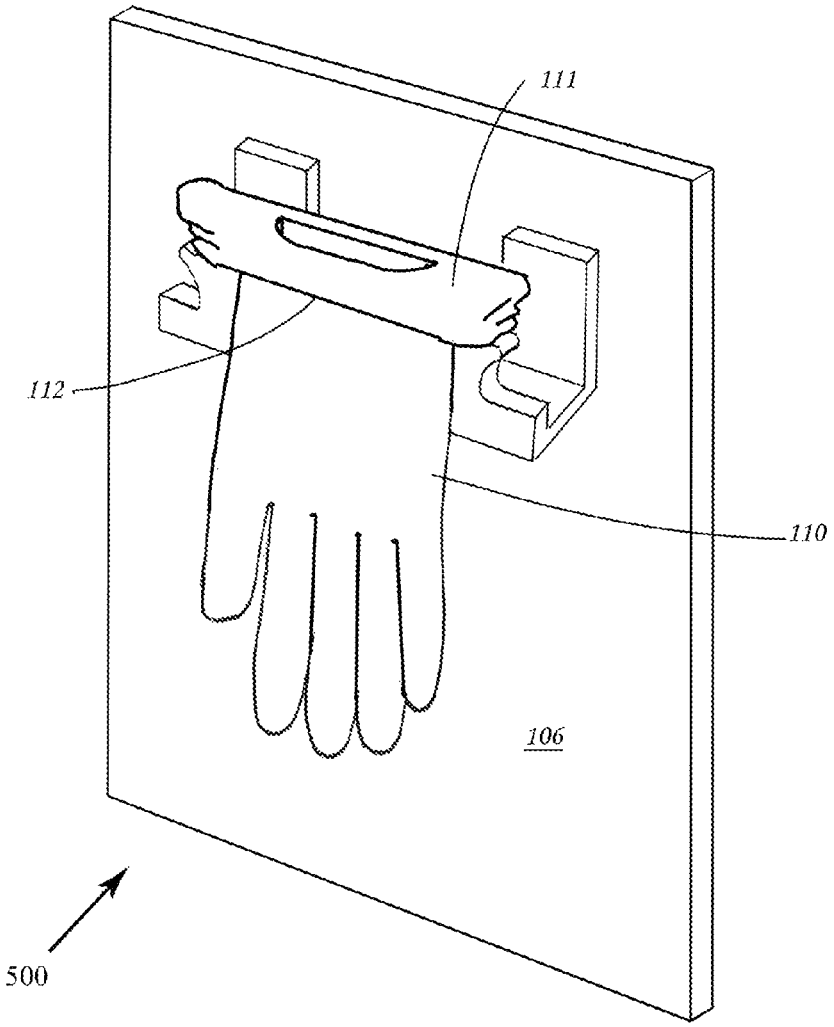
FIG. 5B is a perspective view of a glove dispenser, illustrating an exemplary glove attachment area stand-off from the platform face with glove attached thereon, in accordance with an embodiment of the present disclosure.

By reference to FIGS. 5A and 5B, an exemplary glove dispenser 500, embodying the scope of the present invention, provides an alternative glove attachment area 104, which is configured stand-off from platform face 106. In this embodiment, gloves 110 hang freely from glove attachment area 104, and generally, do not rest on the platform face 106, thereby allowing more gloves to be placed on a glove dispenser 500. In addition, gap "G" provides additional space for a user to don gloves without interference from the platform face 106. Furthermore, the left side and the right side of a glove attachment area 104 may be configured onto a platform face 106 by screws, glue, molded with the platform face 106 as one piece, or other attachment means as known in the art. Though generally horizontally opposed to each other, the lips 102 and indents 103 on the left side and the right side of the glove attachment area 104, respectively, may be oriented in any direction with respect to the platform face 106.

Figure 6B:
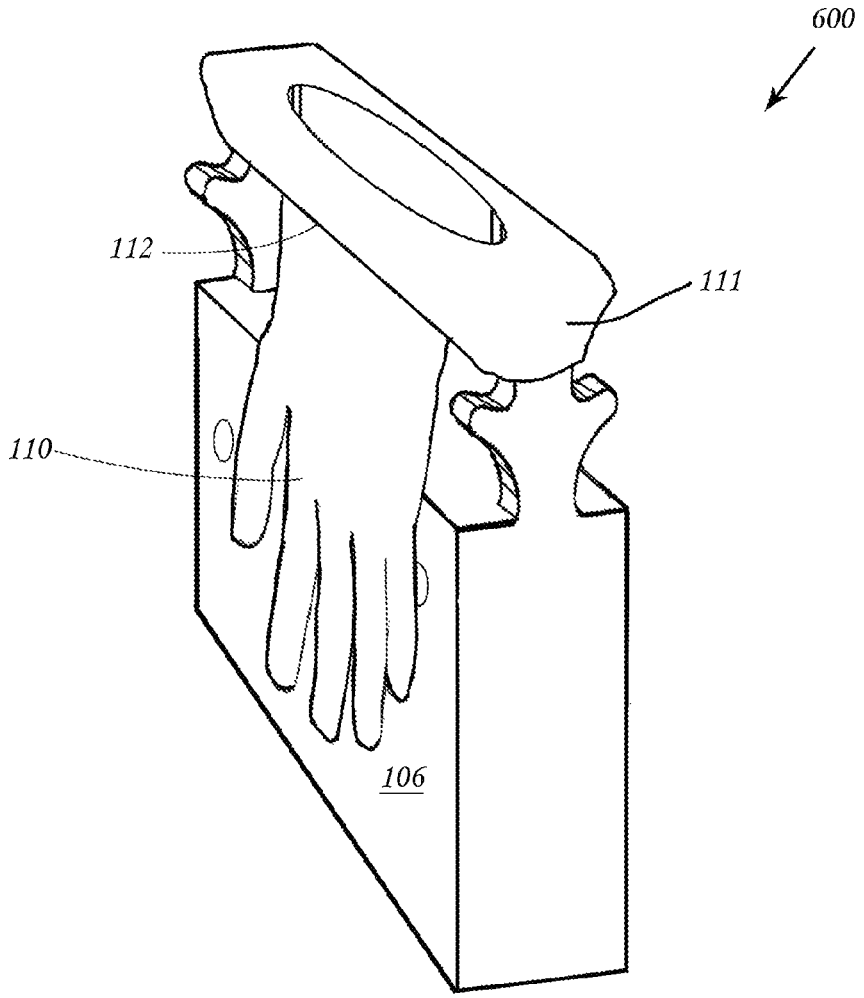
FIG. 6B is a perspective view of an alternative configuration of a glove dispenser, illustrating an exemplary alternative glove attachment area with glove attached thereon, in accordance with various embodiments of the present disclosure.
Figure 6C:
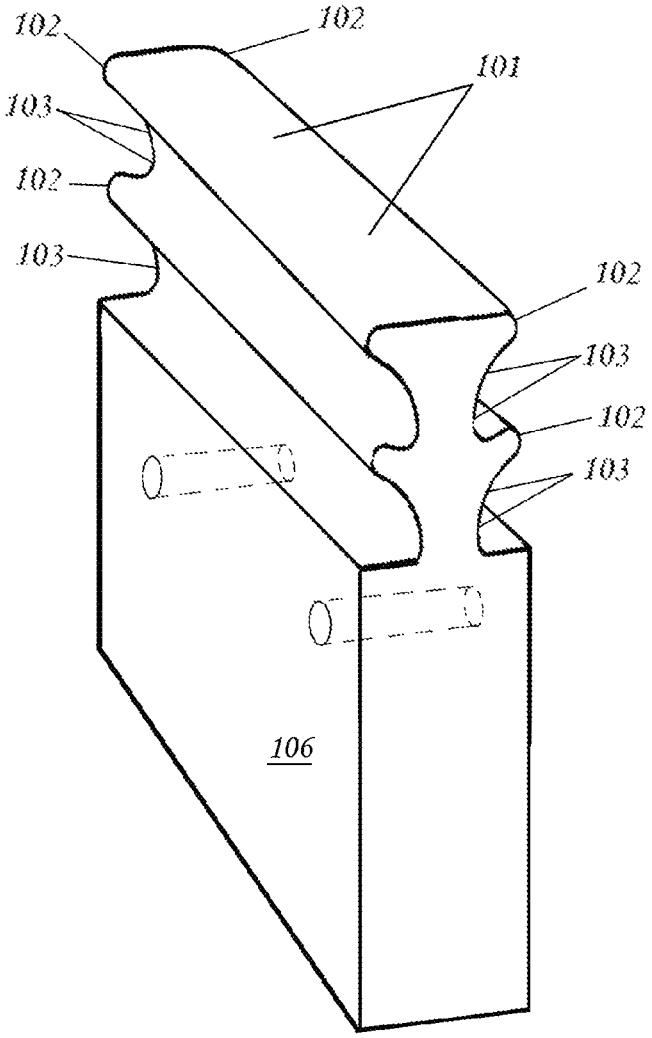
FIG. 6C is a perspective view of an alternative configuration of the glove dispenser of FIG. 6A, illustrating solid fill between lips and indents from the left side to the right side of the glove attachment area, in accordance with various embodiments of the present disclosure.

FIGS. 6A-6C illustrate yet other embodiments of the present invention. As shown in exemplary embodiment 600, the platform face 106 of FIG. 6A includes a glove attachment area 104 stemming vertically therefrom. The glove attachment area 104 has lips 102 and indents 103 formed on the front and the back of the left side and the right side of the glove attachment area 104, respectively.

FIG. 6C is a perspective view of an alternative configuration of the glove dispenser of FIG. 6A, illustrating solid fill between the lips 102 and indents 103 from the left side to the right side of the glove attachment area 104. Such a design may be more advantageous for gloves with higher elastic tensioning in general, and in the cuff particularly, thus requiring a glove attachment area 104 with greater rigidity and stability.

Figure 7B:
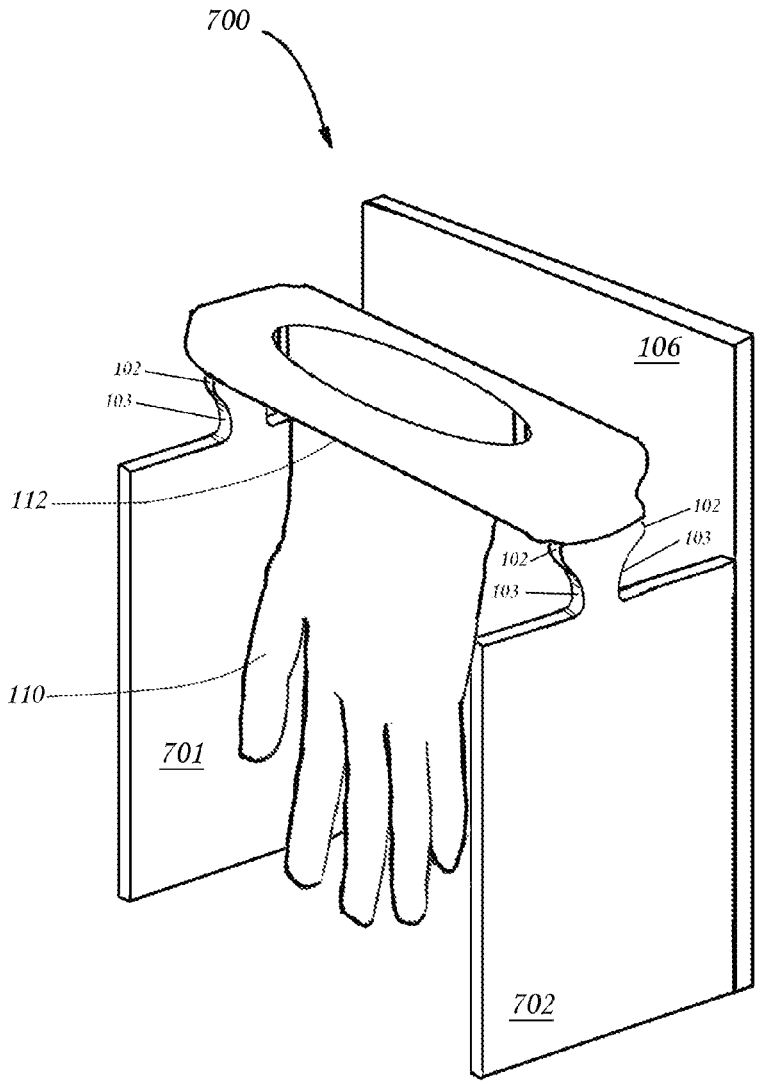
FIG. 7B is a perspective view of a dispenser configured with a left-side panel and a right-side panel, each angled from a platform face and each configured with lips and indents forming a glove attachment area, respectively, showing a glove attached thereon in accordance with various embodiments of the present invention.

In another embodiment of the present invention, FIG. 7A-7B illustrates a glove dispenser 700 configured as a box, comprising a left-side panel 701 and a right-side panel 702, and a platform face 106. Left-side panel 701 and right-side panel 702 are oriented angled to the platform face 106, respectively. Lips 102 and indents 103 on the left-side panel 701 and right-side panel 702, respectively, form a glove attachment area 104 thereby providing means for attaching gloves 110 thereto. Exemplary glove dispenser 700 provides a user easier access to gloves 110 from the glove attachment area 104. Similarly, to conventional boxed disposable gloves, a glove dispenser 700 configured as a box may, but not necessarily, comprise a bottom panel and/or a front panel to enclose gloves 110 as a means for providing additional protection to gloves 110 from the environment. (Note: It is not necessary that dispenser 700 include a bottom panel and/or a front panel.)

Figure 7C:
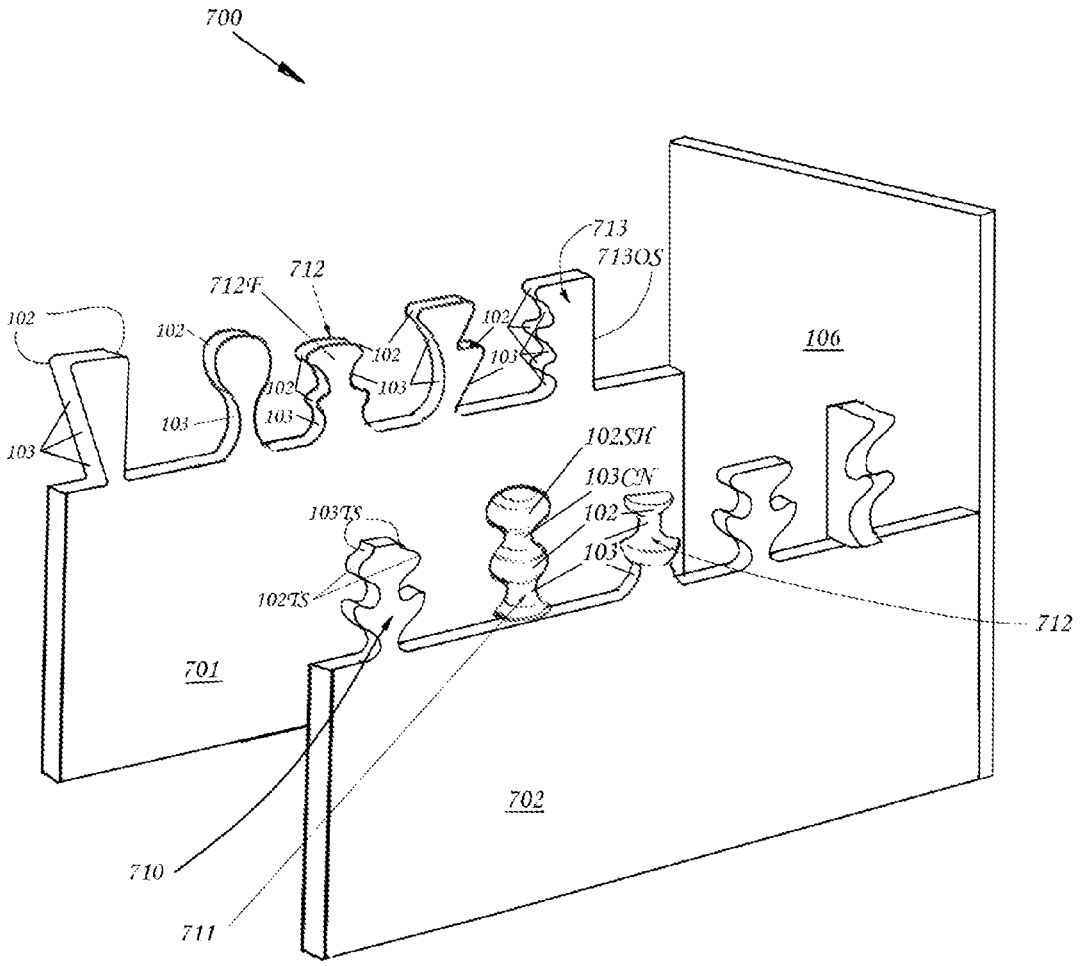
FIG. 7C is a perspective view of a dispenser configured with a left-side panel and a right-side panel, each angled from a platform face and each configured with a plurality of lips and indents forming multiple glove attachment areas, and exemplifying various configurations of lips and indents, respectively.

By reference to FIG. 7C, exemplary dispenser box 700 may be configured with a plurality of glove attachment areas 104 to, for example, provide additional gloves 110 to a user. In addition, FIG. 7C illustrates various exemplary embodiments of lip 102 and indent 103 configurations on glove attachment areas 104. Those skilled in the art will recognize that the exemplary embodiments as shown in FIG. 7C may have a plurality of glove attachment areas 104 and various permutations of lips 102 and indents 103. It is contemplated that on any side of a glove attachment area 104, lips 102 and indents 103 may be configured as various geometrical shapes (e.g., angular, spherical, conical, ellipsoid, etc.). For example, and according to various embodiments of the present invention, exemplary glove attachment element 710 illustrates that the position of lips 102 and indents 103 forming part of a glove attachment area 104 may be ordered such that indents 103TS are on the topmost surface of the glove attachment element 710 followed by lips 102TS in the direction toward platform panel 702. In addition, FIG. 7C illustrates that a glove attachment element 711 may be constructed with one or more spherical lips 102SH and one or more conical indents 103CN. Alternatively, a glove attachment element 712 may be constructed similarly to glove attachment element 711; however, surface volumes may be irregular where, for example, the exemplary glove attachment element 712 includes a flat face 712F. Furthermore, an exemplary glove attachment element 713 illustrates that lips 102 and indents 103 may be constructed on one side of a glove attachment element 713 while an opposing side 713OS may not have lips or indents constructed thereupon.

Figure 7D:
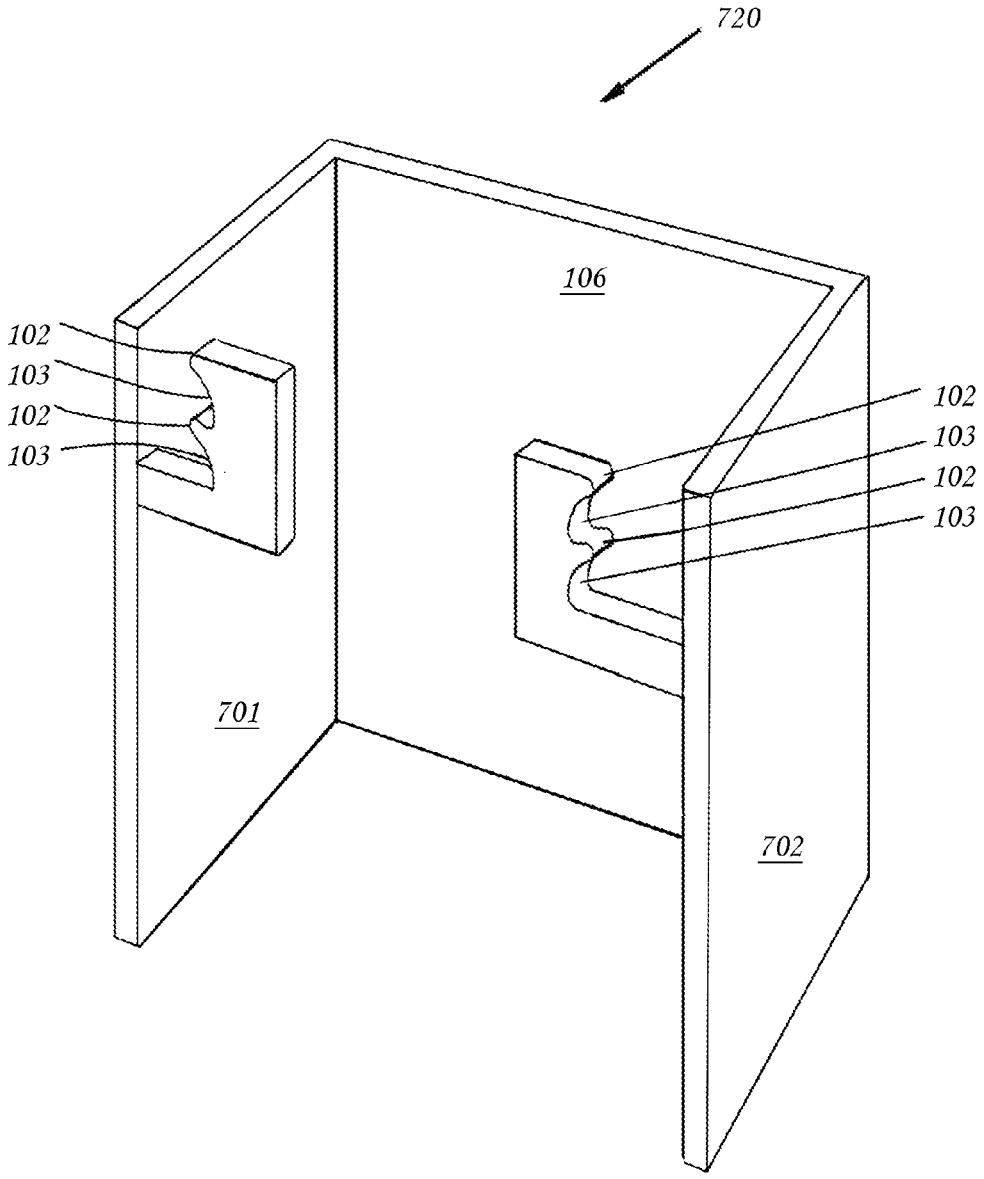
FIG. 7D is a perspective view of a dispenser configured with a left-side panel and a right-side panel, each angled from a platform face, where the glove attachment areas are stand-off from each side panel, respectively.
Figure 7E:
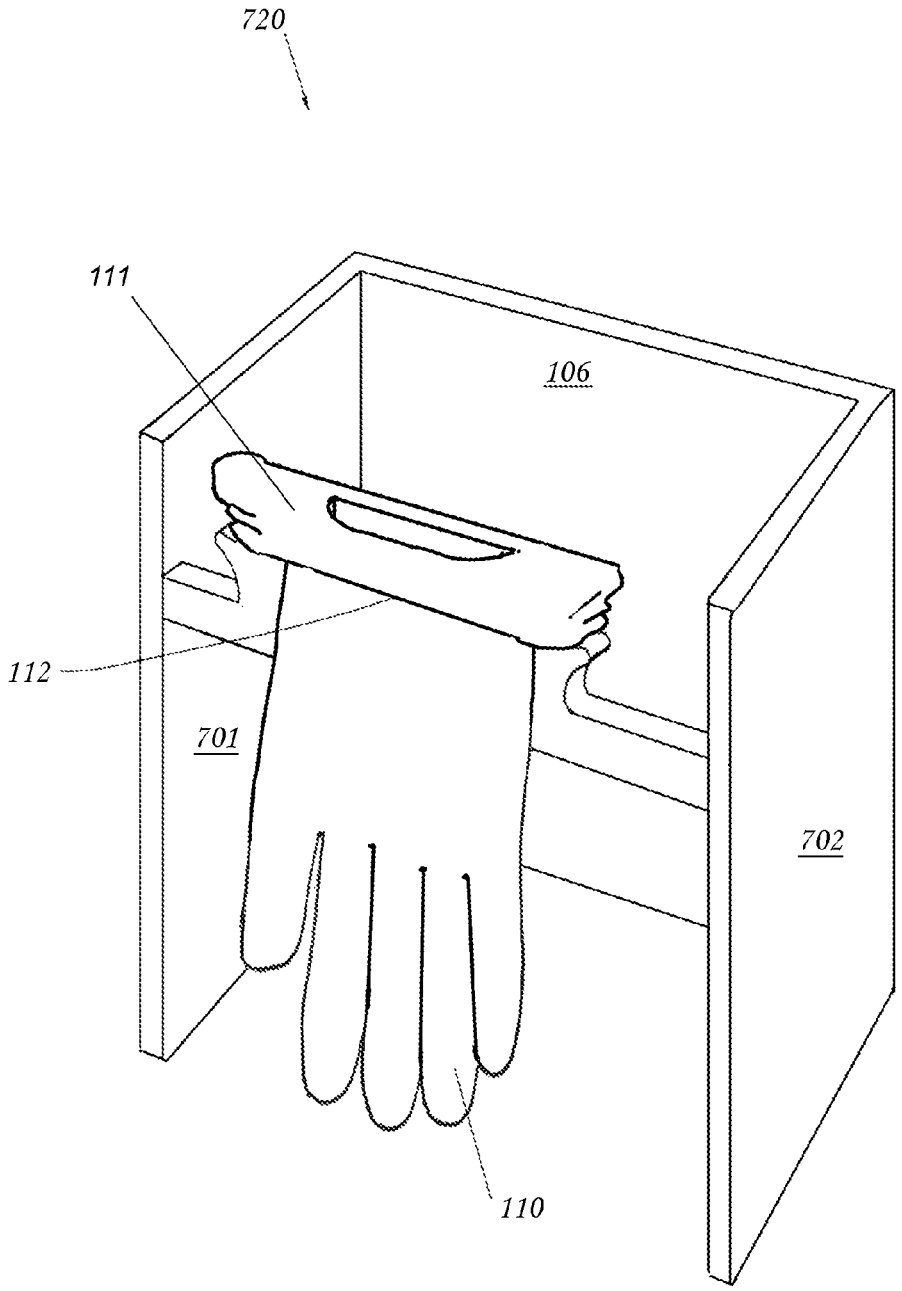
FIG. 7E is a perspective view of a dispenser configured with a left-side panel and a right-side panel, each angled from a platform face, wherein the glove attachment areas are stand-off from each side panel, showing a glove attached thereon in accordance with an embodiment of the present invention, respectively.

FIG. 7D-7E is a perspective view of another embodiment of exemplary dispenser 720 configured with a left-side panel 701 and a right-side panel 702, each angled from a platform face 106, where the left side and the right side of a glove attachment area 104 are stand-off from each side panel, respectively. A glove dispenser 700 configured with glove attachment area 104 may provide additional protection of attached gloves 110 from damage during shipping and/or handling.

Figure 8:
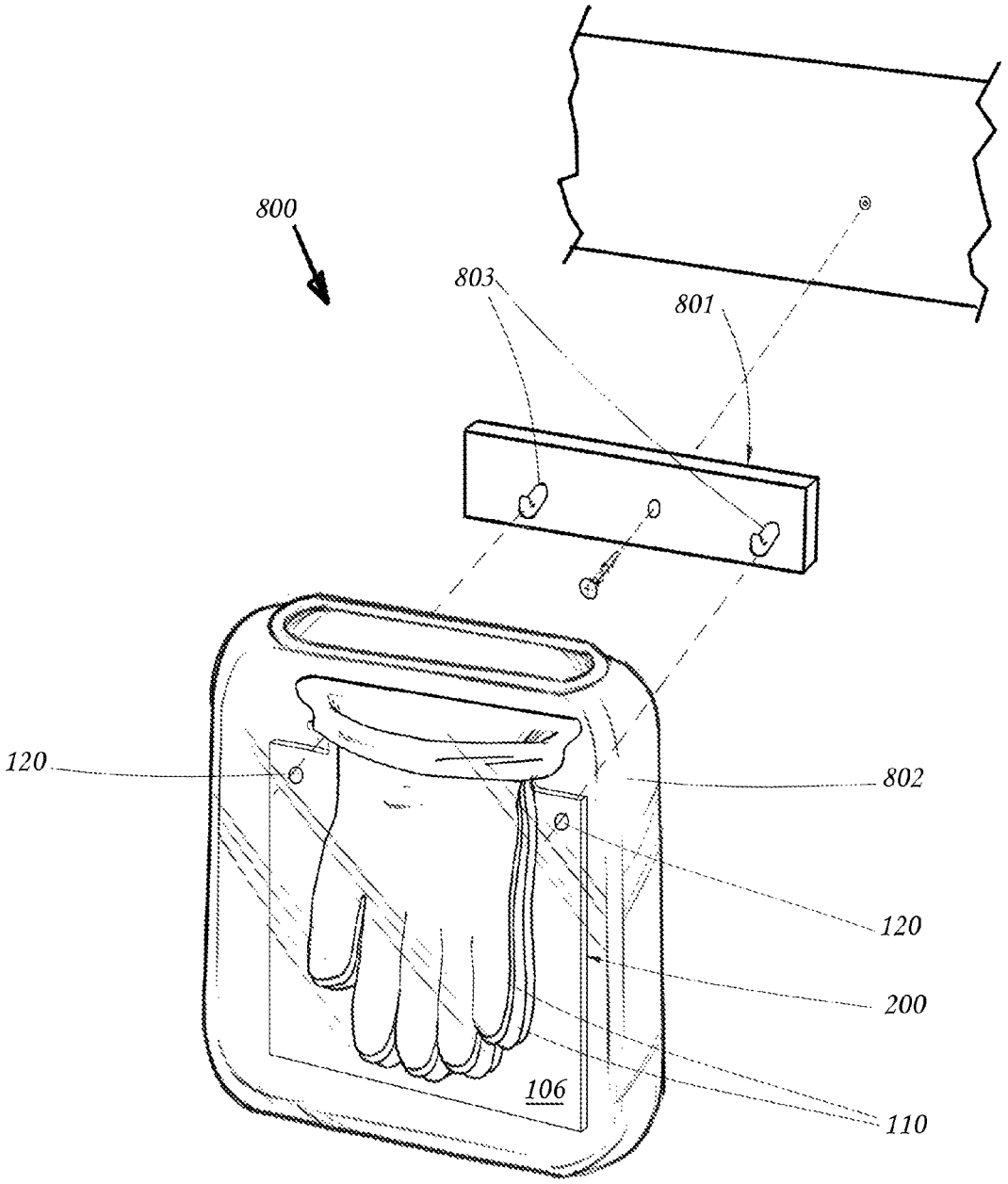
FIG. 8 is an exploded perspective view of a glove dispenser system having platform, packaged gloves, and mounting apparatus, in accordance with various embodiments of the present invention.

FIG. 8 illustrates a typical arrangement of a glove dispensing system 800 comprising an exemplary glove dispenser 200, dispenser mounting holes 120, gloves 110, mounting support 801 (e.g., a wall surface), glove packaging 802, and fasteners 803 according to an embodiment of the present invention. The mounting holes 120 may be holes through which fasteners 803 (e.g., screws, fish-eye hooks, or other attachment means) are used to mount the dispenser 200 to a mounting support 801. It is contemplated that the exemplary dispenser 200 may also be attached to the mounting support 801 by other attachment means such as Velcro. Furthermore, dispenser 200 may be attached to or inserted into a prefabricated dispenser holder such as the Stainless Steel Glove Box Holder® manufactured Medline. Mounting the dispenser 200 so that it is detachable from the mounting support 801 allows an empty dispenser 200 to be easily removed for replacement with a new glove-filled dispenser 200. Any dispenser may be configured with appropriate mounting holes 120 to be placed on the mounting support 801. It is contemplated that any platform face 106, such as those configured in accordance with FIG. 7A and the like, may be configured to accommodate additional space around its perimeter for providing dispenser mounting holes 120, or other means for attaching to mounting support 801. In addition, any of above dispensers, such as dispensers 100, 200, 201 and the like, may include a bottom panel (not shown) to provide means for standing or attaching the dispenser in an upright position.

In the exemplary embodiment 800 of a glove dispensing system, it is contemplated that glove dispenser 200 may be of any other type of glove dispenser such as glove dispenser 201, 202, 203, 500, 600, 700, etc.

Glove packaging 802 may be clear or opaque plastic material, or any other structure that protects gloves 110 from the environment. Materials and structures used for packaging 802 are selected and configured to enable a user to insert and maneuver hands in the packaging 802 while donning gloves.

Thus, it is seen, in accordance with the disclosure herein and the accompanying drawings, that the at least one embodiment of the glove dispenser and system provides a sanitary means of dispensing and donning disposable and non-disposable gloves by eliminating a user's contact with the outside surface of a glove. Those skilled in the art will appreciate that a glove dispensing system may be made sterile by using sterile materials, enclosures, and manufacturing practices which falls within the scope of the present invention. Those skilled in the art would also appreciate that features of the present invention (e.g., lips, indents, and glove attachment areas) may be adapted and modified in various permutations as exemplified herein. In the exemplary embodiments, it is contemplated that elements of the present invention (e.g., lips, indents, and glove attachment areas) may be of varying sizes, shapes, and orientations without departure from the scope and spirit of the invention.

Lips and indents forming the glove attachment area may be oriented as planar, angular, curvilinear, or any permutation thereof, with respect to the plane of a platform face. In addition, lips and indents may face in any suitable direction as needed for attaching gloves. It is contemplated that relocation of such features could be done to accommodate gloves of varying quantities, sizes, construction, and material types, and to provide user convenience for the glove donning process. Any lip or indent may be "turned" on its axis to be configured as any volume-filled shape such as a sphere or a cone.

In addition, gloves have been described as having beads. For the sake of clarity, the scope of the invention includes gloves that are non-beaded as well. The term bead, as used herein, is intended to describe the end of the glove, above the cuff, terminating near the wrists and/or arms. Also, as used herein, "elastic or elastically" refers to any material which can be stretched, and has the property of tending to return to its original shape once released. Furthermore, the at least one embodiment of the glove dispenser also reduces the cost of such dispensing systems by using conventionally designed sanitary gloves, while providing reprocessing of the empty glove dispenser.

While the above description contains many specificities, these should not be construed as limitations on the scope, but rather as an exemplification of one or more embodiments thereof. It should be understood that the broadest scope of this invention includes modifications such as diverse shapes, sizes, and materials. Furthermore, the exemplary glove dispensing apparatus is useful in consumer and commercial markets such as hospitals, homes, hospices, medical offices, industrial and scientific environments where gloves are similarly used. Accordingly, the scope of the present invention should be determined, not by the embodiments illustrated, but by the appended claims and their legal equivalents.

What is claimed is:

1. A glove dispensing apparatus for retaining and donning gloves, the apparatus comprising:

a glove attachment area configured on a platform, said platform having a left side and a right side, wherein the glove attachment area comprises lips and indents for attaching and holding the cuff of one or more gloves thereto, respectively; and wherein the one or more gloves have their cuffs folded to expose an inside portion of the cuff; and wherein the one or more gloves have a bead, said bead of the one or more gloves rests proximate to indents on the glove attachment area; and wherein the cuff of the glove is releasably attached over the lips of the glove attachment area.

2. The glove dispensing apparatus of claim 1, comprising a glove attachment area further comprising a plurality of lips and indents.

3. The glove attachment area of claim 2, wherein the plurality of lips are curvilinear in shape.

4. The glove attachment area of claim 2, wherein the plurality of lips are angled in shape.

5. The glove attachment area of claim 2, wherein the plurality of indents are curvilinear in shape.

6. The glove attachment area of claim 2, wherein the plurality of indents are angled in shape.

7. The platform of claim 1 comprising a plurality of glove attachment areas configured thereon.

8. The glove dispensing apparatus of claim 1, wherein one or more glove attachment areas are configured stand-off from a platform face.

9. The platform of claim 1 comprising one or more glove attachment areas stemming vertically from said platform.

10. The one or more glove attachment areas of claim 9 wherein the glove attachment area from the left side to the right side of a platform is solid filled.

11. The glove dispensing apparatus of claim 1 wherein the platform comprises a left side panel and a right side panel comprising one or more glove attachment areas configured thereupon.

12. A method of retaining a glove and donning a glove to a hand comprising:

providing a glove attachment area configured on a platform having a left side and the right, wherein the glove attachment area comprises lips and indents for attaching the cuff of the one or more gloves and for holding the one or more gloves, respectively; and stretching the cuff of the one or more gloves onto the glove attachment area, wherein the one or more gloves having their cuffs folded to expose an inside portion of the cuff of the one or more gloves; and wherein the inside portion of the cuff of the glove is releasably attached over the lips of the glove attachment area.

13. The method of claim 12, further comprising:

a user pulling on the inside portion of the cuff of a glove attached to the glove attachment area with a first hand so that the glove is opened, said user inserting another hand into the opened glove while releasing the cuff with the first hand, causing the glove to become donned to the another hand; and said user, releasing the donned another hand from the glove attachment area as the another hand is pulled upward and away from the glove attachment area.

14. A glove dispensing system, comprising:

a glove attachment area configured on a platform having a left side and a right side, wherein the glove attachment area comprises lips and indents for attaching the cuff of one or more gloves and for holding the cuff of the one or more gloves, respectively; and wherein the platform is attached to a mounting support, said mounting support configured for receiving attachment means; and wherein the platform, having gloves assembled thereon, is configured for encasement in protective packaging.

15. The glove dispensing apparatus of claim 1, wherein the platform is comprised of one or more glove attachment areas.

16. The glove dispensing apparatus of claim 1, wherein the platform includes holes for mounting said platform to the mounting support.

17. The glove dispensing apparatus of claim 14, wherein the platform comprises a left side panel and a right side panel comprising one or more glove attachment areas configured thereupon.

* * * * *